US009637278B2

(12) United States Patent
Borchardt et al.

(10) Patent No.: US 9,637,278 B2
(45) **Date of Patent: *May 2, 2017**

(54) NON-CONTINUOUSLY LAMINATED MULTI-LAYERED BAGS WITH RIBBED PATTERNS AND METHODS OF FORMING THE SAME

(75) Inventors: Michael G. Borchardt, Naperville, IL (US); Kyle R. Wilcoxen, Chicago, IL (US); Robert W. Fraser, Lombard, IL (US); Robert T. Dorsey, Western Springs, IL (US); Shaun T. Broering, Fort Thomas, KY (US); Jack A. MacPherson, Aurora, IL (US); Scott Binger, Bridgeview, IL (US); Ken Cisek, Chicago, IL (US); Theodore J. Fish, Downers Grove, IL (US)

(73) Assignee: The Glad Products Company, Oakland, CA (US)

( * ) Notice: Subject to any disclaimer, the term of this patent is extended or adjusted under 35 U.S.C. 154(b) by 620 days.

This patent is subject to a terminal disclaimer.

(21) Appl. No.: 13/362,608

(22) Filed: Jan. 31, 2012

(65) Prior Publication Data

US 2012/0134606 A1 May 31, 2012

Related U.S. Application Data

(63) Continuation-in-part of application No. 12/869,623, filed on Aug. 26, 2010, now Pat. No. 8,876,382, (Continued)

(51) Int. Cl.

| | |
|---|---|
| ***B65D 33/28*** | (2006.01) |
| ***B65D 30/08*** | (2006.01) |
| ***B65F 1/00*** | (2006.01) |

(52) U.S. Cl.
CPC ..... *B65D 33/28* (2013.01); *B65D 31/02* (2013.01); *B65F 1/0006* (2013.01); (Continued)

(58) Field of Classification Search
CPC ..... B29C 55/18; B32B 7/12; B65F 1/0006; B65D 33/28; B65D 31/02; (Continued)

(56) References Cited

U.S. PATENT DOCUMENTS 2,593,328 A * 4/1952 Meaker ..... 383/101
2,714,571 A * 8/1955 Irion et al. ..... 156/244.24
(Continued)

FOREIGN PATENT DOCUMENTS

WO WO97/29966 8/1997

*Primary Examiner* — Peter Helvey
(74) *Attorney, Agent, or Firm* — Thomas C. Feix

(57) ABSTRACT

Methods for creating multi-layered bags with increased or maintained strength involve forming a ribbed pattern in one or more film layers of a multi-layered bag. The method also includes non-continuously laminating the film layers of the multi-layered bag together. In one or more implementation, a transverse direction ring rolling process forms the ribbed pattern and bonds the film layers together. In one or more additional implementations, the ribbed pattern and lamination are formed separately. Still further implementations include forming network patterns one or more film layers of a multi-layered bag. Multi-layered bags formed in accordance with one or more implementations of the present invention include one or more of increased strength or reduced basis weight.

20 Claims, 11 Drawing Sheets

Related U.S. Application Data which is a continuation-in-part of application No. 13/273,384, filed on Oct. 14, 2011, now Pat. No. 8,888,365, which is a continuation-in-part of application No. 12/947,025, filed on Nov. 16, 2010, now Pat. No. 8,603,609, said application No. 13/362,608 is a continuation-in-part of application No. 12/574,894, filed on Oct. 7, 2009, now abandoned.

(60) Provisional application No. 61/239,469, filed on Sep. 3, 2009, provisional application No. 61/261,673, filed on Nov. 16, 2009, provisional application No. 61/106,784, filed on Oct. 20, 2008.

(52) U.S. Cl.
CPC ..... *B31B 2219/23* (2013.01); *B31B 2219/88* (2013.01); *B31B 2237/05* (2013.01); *B31B 2237/10* (2013.01); *B31B 2237/406* (2013.01); *Y10T 156/1002* (2015.01)

(58) Field of Classification Search
CPC ..... Y10T 428/2457; Y10T 156/1002; B31B 2219/23; B31B 2219/88; B31B 2237/05; B31B 2237/10; B31B 2237/406
USPC ..... 383/109, 112, 113, 116, 119
See application file for complete search history.

(56) References Cited

U.S. PATENT DOCUMENTS 3,029,853 A * 4/1962 Piazze ..... 383/75
3,058,868 A * 10/1962 Schroeder ..... 156/153
3,130,647 A * 4/1964 Anderson et al. ..... 493/193
3,220,057 A * 11/1965 Walton ..... 425/385
3,224,574 A * 12/1965 McConnell et al. ..... 242/160.1
3,318,759 A * 5/1967 Anderson ..... 428/340
3,322,613 A * 5/1967 Rasmussen ..... 428/484.1
3,485,437 A * 12/1969 Gruentzel et al. ..... 383/107
3,494,457 A * 2/1970 Titchenal ..... 206/484
3,549,381 A * 12/1970 Kinsinger ..... 426/77
3,550,839 A * 12/1970 Clayton et al. ..... 383/116
3,622,422 A * 11/1971 Newman ..... 156/309.6
3,735,918 A * 5/1973 Tundermann ..... 383/32
3,746,607 A * 7/1973 Harmon et al. ..... 428/167
3,760,940 A * 9/1973 Bustin ..... 383/35
3,772,968 A 11/1973 Ruda
3,857,144 A * 12/1974 Bustin ..... 156/209
3,954,933 A * 5/1976 Rasmussen ..... 264/145
3,973,063 A * 8/1976 Clayton ..... 428/35.2
3,984,047 A * 10/1976 Clayton et al. ..... 383/119
4,076,121 A * 2/1978 Clayton et al. ..... 206/390
4,116,892 A * 9/1978 Schwarz ..... 521/62
4,143,195 A * 3/1979 Rasmussen ..... 428/116
4,153,664 A * 5/1979 Sabee ..... 264/280
4,153,751 A * 5/1979 Schwarz ..... 521/50
4,273,549 A 6/1981 Pezzana et al.
4,289,832 A * 9/1981 Schwarz ..... 521/55
4,302,495 A * 11/1981 Marra ..... 428/110
4,343,848 A * 8/1982 Leonard, Jr. ..... 428/156
4,379,197 A * 4/1983 Cipriani et al. ..... 428/220
4,438,167 A * 3/1984 Schwarz ..... 428/138
4,517,714 A * 5/1985 Sneed et al. ..... 28/103
4,518,643 A * 5/1985 Francis ..... 428/131
4,522,203 A * 6/1985 Mays ..... 128/849
4,614,679 A * 9/1986 Farrington et al. ..... 428/138
4,629,064 A 12/1986 Barner
4,692,368 A * 9/1987 Taylor et al. ..... 428/137
4,704,238 A * 11/1987 Okuyama et al. ..... 264/41
4,753,840 A * 6/1988 Van Gompel ..... 428/171
4,793,885 A * 12/1988 Rasmussen ..... 156/200
4,846,586 A 7/1989 Bruno
4,890,936 A 1/1990 Cooper
4,925,711 A 5/1990 Akao et al.
4,930,905 A * 6/1990 Sharps, Jr. ..... 383/75
4,993,844 A 2/1991 Robinson et al.
5,028,289 A * 7/1991 Rasmussen ..... 156/229
5,035,941 A * 7/1991 Blackburn ..... 442/398
5,078,508 A * 1/1992 Johan et al. ..... 383/75
5,100,721 A * 3/1992 Akao ..... 428/218
5,133,607 A * 7/1992 Bonke ..... 383/75
5,167,897 A * 12/1992 Weber et al. ..... 264/288.8
5,205,650 A * 4/1993 Rasmussen ..... 383/107
5,293,184 A * 3/1994 Ishizuka ..... 347/1
5,296,184 A * 3/1994 Wu et al. ..... 264/154
5,382,461 A * 1/1995 Wu ..... 428/86
5,390,875 A * 2/1995 Gietman et al. ..... 242/521
5,422,172 A * 6/1995 Wu ..... 442/62
5,455,992 A * 10/1995 Kurschatke et al. ..... 26/99
5,518,801 A * 5/1996 Chappell et al. ..... 428/152
5,554,093 A * 9/1996 Porchia et al. ..... 493/240
5,618,111 A * 4/1997 Porchia et al. ..... 383/63
5,650,214 A * 7/1997 Anderson et al. ..... 428/152
5,716,137 A 2/1998 Meyer
5,804,265 A 9/1998 Allison et al.
5,851,937 A * 12/1998 Wu et al. ..... 442/394
5,861,074 A * 1/1999 Wu ..... 156/229
5,865,926 A * 2/1999 Wu et al. ..... 156/229
5,881,883 A 3/1999 Siegelman
5,885,262 A * 3/1999 Wheeler ..... 604/327
6,013,151 A * 1/2000 Wu et al. ..... 156/229
6,059,458 A * 5/2000 Belias et al. ..... 383/75
6,139,186 A * 10/2000 Fraser ..... 383/77
6,150,647 A * 11/2000 Anderson et al. ..... 219/730
6,214,147 B1 * 4/2001 Mortellite et al. ..... 156/201
6,254,736 B1 * 7/2001 Earl et al. ..... 204/164
6,258,308 B1 * 7/2001 Brady et al. ..... 264/210.2
6,264,864 B1 * 7/2001 Mackay ..... 264/154
6,264,872 B1 * 7/2001 Majors et al. ..... 264/284
6,265,045 B1 * 7/2001 Mushaben ..... 428/77
6,361,784 B1 * 3/2002 Brennan et al. ..... 424/402
6,368,444 B1 * 4/2002 Jameson et al. ..... 156/229
6,385,818 B1 * 5/2002 Savicki, Sr. ..... 24/30.5 R
6,394,652 B2 * 5/2002 Meyer et al. ..... 383/118
6,402,377 B1 * 6/2002 Vo et al. ..... 383/75
6,416,452 B1 7/2002 Meyer
6,513,975 B1 * 2/2003 Jackson et al. ..... 383/118
6,605,172 B1 * 8/2003 Anderson et al. ..... 156/199
6,695,476 B2 * 2/2004 Jackson et al. ..... 383/77
6,799,680 B2 * 10/2004 Mak ..... 206/524.8
6,939,042 B2 * 9/2005 Rusnak et al. ..... 383/71
6,953,510 B1 * 10/2005 Mackay et al. ..... 156/229
6,966,697 B2 * 11/2005 Patridge et al. ..... 383/107
7,220,053 B2 * 5/2007 Wu ..... 383/105
7,270,861 B2 * 9/2007 Broering et al. ..... 428/35.7
7,306,729 B2 * 12/2007 Bacino et al. ..... 210/500.22
7,687,134 B2 * 3/2010 Withers ..... 428/156
7,938,635 B2 * 5/2011 Heilman et al. ..... 425/101
8,263,210 B2 * 9/2012 Rasmussen ..... 428/174
8,685,870 B2 * 4/2014 Austin et al. ..... 442/389
2002/0074691 A1 * 6/2002 Mortellite et al. ..... 264/288.4
2003/0007704 A1 * 1/2003 Miller ..... 383/76
2003/0024625 A1 * 2/2003 McAmish et al. ..... 156/73.1
2004/0170810 A1 * 9/2004 Rasmussen ..... 428/174
2004/0179754 A1 9/2004 Taheri
2005/0123726 A1 * 6/2005 Broering et al. ..... 428/172
2005/0129337 A1 * 6/2005 Sabounjian ..... 383/117
2006/0083900 A1 * 4/2006 Ashraf ..... 428/182
2006/0093766 A1 * 5/2006 Savicki et al. ..... 428/35.2
2006/0177161 A1 * 8/2006 Turvey ..... 383/120
2007/0166503 A1 * 7/2007 Hannigan ..... 428/59
2007/0254120 A1 * 11/2007 Rasmussen ..... 428/35.7
2007/0257402 A1 * 11/2007 Rasmussen ..... 264/339
2008/0124461 A1 * 5/2008 Leener et al. ..... 427/211
2008/0137995 A1 * 6/2008 Fraser et al. ..... 383/75
2009/0003736 A1 * 1/2009 Alipour et al. ..... 383/42
2009/0029114 A1 * 1/2009 Cancio et al. ..... 428/174
2009/0068427 A1 * 3/2009 Patel et al. ..... 428/212
2009/0233041 A1 * 9/2009 Rasmussen ..... 428/101
2009/0264847 A1 * 10/2009 Ashton et al. ..... 604/367
2010/0046860 A1 * 2/2010 Kent et al. ..... 383/75
2010/0046861 A1 * 2/2010 Wilcoxen ..... 383/119
2010/0098354 A1 * 4/2010 Fraser et al. ..... 383/72

(56) References Cited

U.S. PATENT DOCUMENTS

| | | | | |
|---|---|---|---|---|
| 2010/0195937 | A1* | 8/2010 | Fraser et al. | 383/105 |
| 2011/0052104 | A1* | 3/2011 | Wilcoxen et al. | 383/75 |
| 2011/0052105 | A1 | 3/2011 | Wilcoxen et al. | |
| 2011/0117307 | A1 | 5/2011 | Fraser et al. | |
| 2011/0255809 | A1* | 10/2011 | Tucker et al. | 383/119 |
| 2011/0317945 | A1* | 12/2011 | Waldron et al. | 383/119 |
| 2012/0033900 | A1* | 2/2012 | Fraser et al. | 383/105 |
| 2012/0039550 | A1* | 2/2012 | MacPherson et al. | 383/109 |
| 2012/0057811 | A1* | 3/2012 | Tucker et al. | 383/72 |
| 2012/0063706 | A1* | 3/2012 | Fraser et al. | 383/109 |
| 2013/0202853 | A1* | 8/2013 | Bergman et al. | 428/167 |
| 2013/0209711 | A1* | 8/2013 | Borchardt et al. | 428/34.8 |
| 2013/0209712 | A1* | 8/2013 | Borchardt et al. | 428/34.8 |

* cited by examiner

NON-CONTINUOUSLY LAMINATED MULTI-LAYERED BAGS WITH RIBBED PATTERNS AND METHODS OF FORMING THE SAME

CROSS-REFERENCE TO RELATED APPLICATIONS

The present application is a continuation in part of U.S. patent application Ser. No. 12/869,623 filed Aug. 26, 2010 now U.S. Pat. No. 8,876,382 and entitled EMBOSSED DRAW TAPE BAG, which claims the benefit of U.S. Provisional Application No. 61/239,469, filed Sep. 3, 2009. The present application is also a continuation in part of U.S. patent application Ser. No. 13/273,384 filed Oct. 14, 2011 now U.S. Pat. No. 8,888,365 and entitled NON-CONTINUOUSLY LAMINATED MULTI-LAYERED BAGS, which is a continuation in part of U.S. patent application Ser. No. 12/947,025 filed Nov. 16, 2010 now U.S. Pat. No. 8,603,609 and entitled DISCONTINUOUSLY LAMINATED FILM, which claims the benefit of U.S. Provisional Application No. 61/261,673, filed Nov. 16, 2009. The present application is also a continuation in part of U.S. patent application Ser. No. 12/574,894 filed Oct. 7, 2009 now abandoned and entitled BAG AND METHODS OF MAKING THE SAME, which claims the benefit of U.S. Provisional Application No. 61/106,784, filed Oct. 20, 2008. Each of the above-referenced applications is hereby incorporated by reference in its entirety.

BACKGROUND OF THE INVENTION

1. The Field of the Invention

This invention relates generally to thermoplastic films and bags formed therefrom.

2. Background and Relevant Art

Among their many applications, it is known to use thermoplastic bags as liners in trash or refuse receptacles. Trash receptacles that employ such liners may be found at many locations, such as, small household kitchen garbage cans. Bags that are intended to be used as liners for such refuse containers are typically made from low-cost, pliable thermoplastic material. When the receptacle is full, the thermoplastic liner actually holding the trash may be removed for further disposal and replaced with a new liner.

It is desirable to reduce the cost of producing the disposable thermoplastic bags as much as possible. Therefore, such bags typically are mass-produced in a high speed manufacturing environment. Other cost savings can be realized by reducing the amount or quality of thermoplastic material utilized to make the bag. Reducing the amount or quality of thermoplastic material forming the bag; however, limits bag strength and toughness, making the bag susceptible to tearing or rupture. Accordingly, there is a need for a thermoplastic bag designed in a manner that reduces material cost while maintaining strength and toughness characteristics and facilitating high-speed manufacturing.

BRIEF SUMMARY OF THE INVENTION

Implementations of the present invention solve one or more problems in the art with apparatus and methods for creating multi-layered bags with one or more layers having a ribbed pattern that provides the bags with increased strength or other desirable properties. Additionally, the ribbed pattern may enhance the properties of the bag while simultaneously lowering the basis weight of the patterned area(s), and thereby, the amount of raw material in the bag. In addition to including ribbed patterns, the layers of the multi-layered bag may be non-continuously laminated together. The non-continuous lamination of adjacent layers can further provide improved strength to the bag.

For example, one implementation of a thermoplastic bag can include a first sidewall comprising a first layer of a thermoplastic material and an adjacent second layer of thermoplastic material. The thermoplastic bag can also include a second sidewall comprising a first layer of a thermoplastic material and an adjacent second layer of thermoplastic material. The second sidewall can be joined to the first sidewall along a first side edge, an opposite second side edge, and a closed bottom edge. The first and second sidewalls can be un-joined along at least a portion of their respective top edges to define an opening. A first plurality of non-continuous bonded regions can secure the first and second layers of the first sidewall together. The first plurality of non-continuous bonded regions can comprise a pattern of linear ribs extending between the first side edge and the second side edge of the first sidewall.

Another implementation of the present invention includes a multi-layered bag comprising a first thermoplastic bag and a second thermoplastic bag positioned within the first thermoplastic bag. Each of the first and second thermoplastic bags can have at least a first portion, a second portion, and first and second opposing sidewalls joined together along a first side edge, an opposite second side edge, and a bottom edge. The multi-layered bag can also include a pattern of linear ribs in at least the first portion of the first thermoplastic bag. The linear ribs can extend between the first side edge and the second side edge. A plurality of non-continuous bonds can secure at least one of the respective first portions or second portions of the first thermoplastic bag and the second thermoplastic bag together.

In addition to the forgoing, a method for forming a plastic bag can involve providing first and second thermoplastic films. The method can also involve passing one or more of the first and second thermoplastic films through TD intermeshing rollers to form a pattern of linear ribs therein. Additionally, the method can involve partially discontinuously laminating at least a portion of the first and second thermoplastic films together. The method can further involve joining at least two edges of the first thermoplastic film together to form a bag configuration.

Additional features and advantages of exemplary embodiments of the present invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
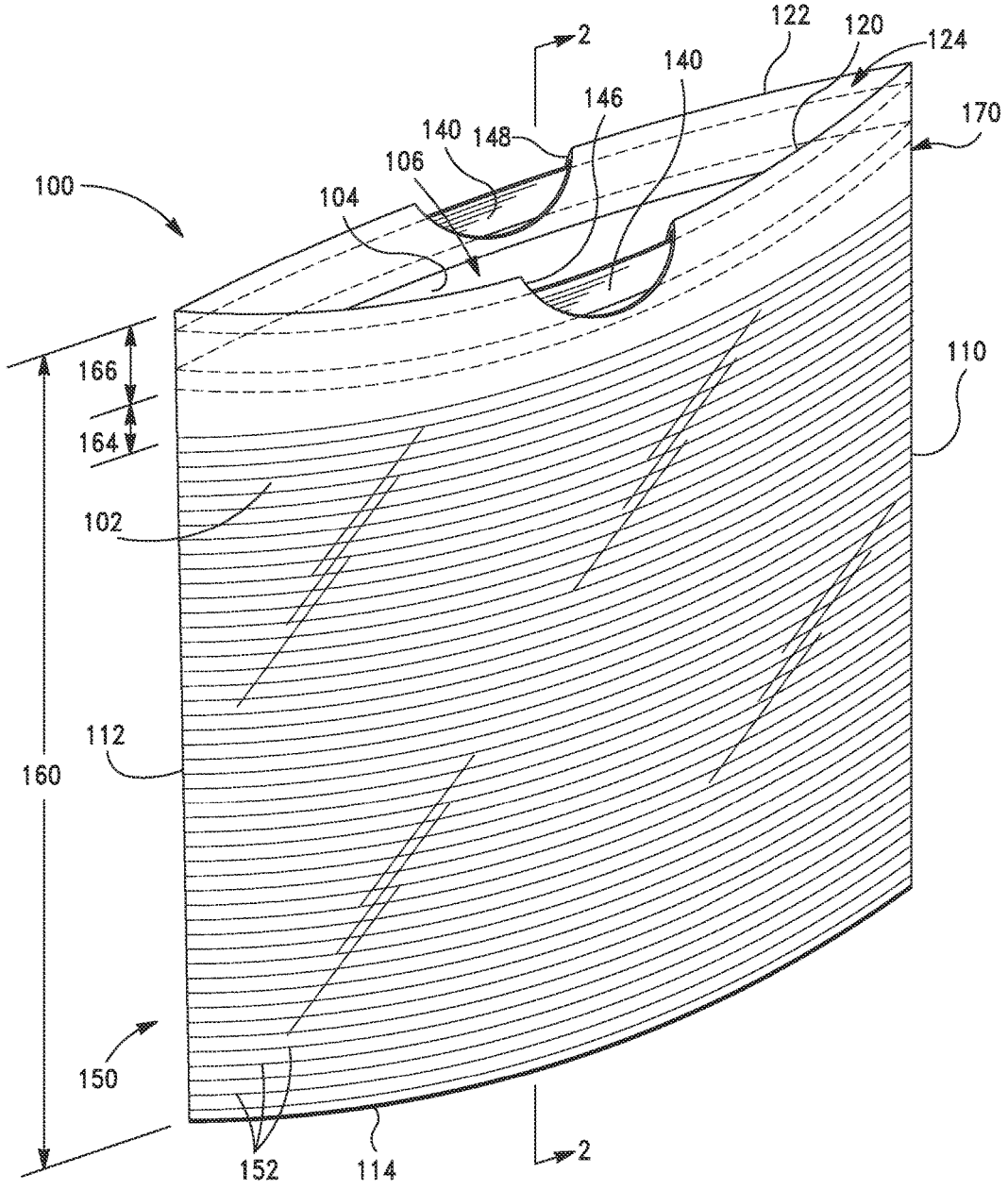
FIG. 1 illustrates a perspective view of a multi-layered thermoplastic bag for use as a trash container liner having a ribbed pattern imparted onto a sidewall of the bag.

One or more implementations of the present invention include apparatus and methods for creating multi-layered bags with one or more layers having a ribbed pattern that provides the bags with increased strength or other desirable properties. Additionally, the ribbed pattern may enhance the properties of the bag while simultaneously lowering the basis weight of the patterned area(s), and thereby, the amount of raw material in the bag. In addition to including ribbed patterns, the layers of the multi-layered bag may be non-continuously laminated together. The non-continuous lamination of adjacent layers can further provide improved strength to the bag.

In particular, the non-continuous bonds or bond regions of adjacent layers of multi-layer films or bags in accordance with one or more implementations can act to first absorb forces via breaking of the bonds prior to allowing that same force to cause failure of the individual layers of the multi-layer film or bag. Such action can provide increased strength to the multi-layer film or bag. In one or more implementations, the non-continuous bonds or bond regions include a bond strength that is advantageously less than a weakest tear resistance of each of the individual films so as to cause the bonds to fail prior to failing of the film layers. Indeed, one or more implementations include bonds that the release just prior to any localized tearing of the layers of the multi-layer bag.

Thus, in one or more implementations, the non-continuous bonds or bond regions of a multi-layer film or bag can fail before either of the individual layers undergo molecular-level deformation. For example, an applied strain can pull the non-continuous bonds or bond regions apart prior to any molecular-level deformation (stretching, tearing, puncturing, etc.) of the individual film layers. In other words, the light bonds or bond regions can provide less resistive force to an applied strain than molecular-level deformation of any of the layers of the multi-layer film or bag. The inventors have surprisingly found that such a configuration of light bonding can provide increased strength properties to the multi-layer film or bag as compared to a film or bag with a monolayer equal thickness or a multi-layer film or bag in which the plurality of layers are tightly bonded together (e.g., continuously laminated, coextruded, or other means).

To provide bags that easily fit into trash canisters and yet are strong and easily removed, the bag may contain both ribbed patterned areas and network patterned areas mixed with un-patterned film areas for optimal functional properties of different sections of the bag. For example, the ribbed patterned areas may provide sufficient physical properties and lower surface contact area at lower film thickness and lower basis weight than the un-patterned film. In another example, the network patterned areas may provide additional stretch or elastic properties and lower surface contact than the un-patterned film. In one or more implementations, the ribbed patterned area may be formed by transverse direction ring rolling. Examples of ribbed patterned areas are described in the specification below. Additionally, the elastic or strainable network patterned areas may be formed by a structural elastic like film ("SELF") process, embossing, or other techniques.

In one or more implementations, the bag may be provided with additional features to help retain it to the trash canister. These features may include forming the thermoplastic sidewall material between the opposing sides to have a stretchable or yieldable characteristic or stretchable drawstring, for example as described in U.S. Pat. App. 20100046860 and incorporated by reference in its entirety herein. In one or more implementations, the sidewall may be formed so that the sheet-like thermoplastic material bunches together as a series of wrinkles or creases. When a pulling force is applied, the bunched together thermoplastic material may un-bunch thereby allowing the bag to stretch or expand. The thermoplastic material may have some shape memory tending to cause the material to re-bunch together, thereby providing an elastic or resilient characteristic to the bag and helping the throat to grip or constrict around the canister. In additional or alternative implementations, the bag may have strips of elastic material attached to one or both of the sidewalls and may extend between the converging portions of the first and second side edges. Like the stretchable sidewall material, the strip of elastic material may help grip and retain the bag to the refuse canister.

As used herein, the terms "lamination," "laminate," and "laminated film," refer to the process and resulting product made by bonding together two or more layers of film or other material. The term "bonding", when used in reference to bonding of multiple layers of a multi-layer film, may be used interchangeably with "lamination" of the layers. According to methods of the present invention, adjacent layers of a multi-layer film are laminated or bonded to one another. The bonding purposely results in a relatively weak bond between the layers that has a bond strength that is less than the strength of the weakest layer of the film. This allows the lamination bonds to fail before the film layer, and thus the film, fails.

The term laminate does not include heated coextruded multilayer films comprising one or more tie layers. As a verb, "laminate" means to affix or adhere (by means of, for example, adhesive bonding, pressure bonding (e.g., ring rolling, embossing, SELFing), ultrasonic bonding, corona lamination, and the like) two or more separately made film articles to one another so as to form a multi-layer structure. As a noun, "laminate" means a product produced by the affixing or adhering just described.

The individual layers of the multi-layer film may each themselves comprise a plurality of layers. Such layers may be significantly more tightly bonded together than the bonding provided by the purposely weak non-continuous bonding in the finished multi-layer film. Both tight and relatively weak lamination can be accomplished by joining layers by mechanical pressure, joining layers with adhesives, joining with heat and pressure, joining by heat, and combinations thereof. Adjacent sub-layers of an individual layer may be coextruded. Coextrusion results in tight bonding so that the bond strength is greater than the tear resistance of the resulting layers (i.e., rather than allowing adjacent layers to be peeled apart through breakage of the bonds, the film will tear).

In one or more implementations, the light lamination or bonding between layers of a multi-layer film may be non-continuous (i.e., discontinuous or partial discontinuous). As used herein the terms "discontinuous bonding" or "discontinuous lamination" refers to lamination of two or more layers where the lamination is not continuous in the machine direction and not continuous in the transverse direction. More particularly, discontinuous lamination refers to lamination of two or more layers with repeating bonded patterns broken up by repeating un-bonded areas in both the machine direction and the transverse direction of the film.

As used herein the terms "partially discontinuous bonding" or "partially discontinuous lamination" refers to lamination of two or more layers where the lamination is substantially continuous in the machine direction or in the transverse direction, but not continuous in the other of the machine direction or the transverse direction. Alternately, partially discontinuous lamination refers to lamination of two or more layers where the lamination is substantially continuous in the width of the article but not continuous in the height of the article, or substantially continuous in the height of the article but not continuous in the width of the article. More particularly, partially discontinuous lamination refers to lamination of two or more layers with repeating bonded patterns broken up by repeating unbounded areas in either the machine direction or the transverse direction.

As used herein, the term "flexible" refers to materials that are capable of being flexed or bent, especially repeatedly, such that they are pliant and yieldable in response to externally applied forces. Accordingly, "flexible" is substantially opposite in meaning to the terms inflexible, rigid, or unyielding. Materials and structures that are flexible, therefore, may be altered in shape and structure to accommodate external forces and to conform to the shape of objects brought into contact with them without losing their integrity. In accordance with further prior art materials, web materials are provided which exhibit an "elastic-like" behavior in the direction of applied strain without the use of added traditional elastic. As used herein, the term "elastic-like" describes the behavior of web materials which when subjected to an applied strain, the web materials extend in the direction of applied strain, and when the applied strain is released the web materials return, to a degree, to their pre-strained condition.

As used herein, the terms "starting gauge," "initial gauge," and "starting thickness" refers to the average distance between the major surfaces of a film before it is incrementally stretched so as to discontinuously bond adjacent layers together. Of course, it is also possible to stretch one or more of the individual layers before they are discontinuously bonded together.

Methods of providing bonding of adjacent layers (i.e., so that the bond strength is less than a weakest tear resistance of the individual layers) can include many techniques, such as adhesive bonding, pressure bonding, ultrasonic bonding, and corona lamination. MD ring rolling, TD ring rolling, or other ring rolling processes (e.g., DD ring rolling or ring rolling that results in a thermoplastic film with strainable networks), and combinations thereof may be used to non-continuously bond adjacent layers of the multilayer film, as will be described in further detail below.

Film Materials

As an initial matter, one or more layers of the films can comprise any flexible or pliable material comprising a thermoplastic material and that can be formed or drawn into a web or film. As described above, the film includes a plurality of layers of thermoplastic films. Each individual film layer may itself include a single layer or multiple layers. Adjuncts may also be included, as desired (e.g., pigments, slip agents, anti-block agents, tackifiers, or combinations thereof). The thermoplastic material of the films of one or more implementations can include, but are not limited to, thermoplastic polyolefins, including polyethylene, polypropylene, and copolymers thereof. Besides ethylene and propylene, exemplary copolymer olefins include, but are not limited to, ethylene vinylacetate (EVA), ethylene methyl acrylate (EMA) and ethylene acrylic acid (EAA), or blends of such olefins. Various other suitable olefins and polyolefins will be apparent to one of skill in the art.

Other examples of polymers suitable for use as films in accordance with the present invention include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), ethylene-propylene rubber, and combinations thereof.

In at least one implementation of the present invention, the film can include linear low density polyethylene. The term "linear low density polyethylene" (LLDPE) as used herein is defined to mean a copolymer of ethylene and a minor amount of an alkene containing 4 to 10 carbon atoms, having a density of from about 0.910 to about 0.926 g/cm$^3$, and a melt index (MI) of from about 0.5 to about 10. For example, one or more implementations of the present invention can use an octene co-monomer, solution phase LLDPE (MI=1.1; ρ=0.920). Additionally, other implementations of the present invention can use a gas phase LLDPE, which is a hexene gas phase LLDPE formulated with slip/AB (MI=1.0; ρ=0.920). One will appreciate that the present invention is not limited to LLDPE, and can include "high density polyethylene" (HDPE), "low density polyethylene" (LDPE), and "very low density polyethylene" (VLDPE). Indeed films made from any of the previously mentioned thermoplastic materials or combinations thereof can be suitable for use with the present invention.

One will appreciate in light of the disclosure herein that manufacturers may form the individual films or webs to be non-continuously bonded together so as to provide improved strength characteristics using a wide variety of techniques. For example, a manufacturer can form a precursor mix of the thermoplastic material including any optional additives. The manufacturer can then form the film(s) from the precursor mix using conventional flat extrusion, cast extrusion, or coextrusion to produce monolayer, bilayer, or multilayered films. In any case, the resulting film will be discontinuously bonded to another film at a later stage to provide the benefits associated with the present invention.

Alternative to conventional flat extrusion or cast extrusion processes, a manufacturer can form the films using other suitable processes, such as, a blown film process to produce monolayer, bilayer, or multilayered films, which are subsequently discontinuously bonded with another film layer at a later stage. If desired for a given end use, the manufacturer can orient the films by trapped bubble, tenterframe, or other suitable processes. Additionally, the manufacturer can optionally anneal the films.

The extruder used can be of a conventional design using a die, which will provide the desired gauge. Some useful extruders are described in U.S. Pat. Nos. 4,814,135; 4,857,600; 5,076,988; 5,153,382; each of which are incorporated herein by reference in their entirety. Examples of various extruders, which can be used in producing the films to be used with the present invention, can be a single screw type modified with a blown film die, an air ring, and continuous take off equipment.

In one or more implementations, a manufacturer can use multiple extruders to supply different melt streams, which a feed block can order into different channels of a multi-channel die. The multiple extruders can allow a manufacturer to form a multi-layered film with layers having different compositions. Such multi-layer film may later be non-continuously laminated with another layer of film to provide the benefits of the present invention.

In a blown film process, the die can be an upright cylinder with a circular opening. Rollers can pull molten plastic upward away from the die. An air-ring can cool the film as the film travels upwards. An air outlet can force compressed air into the center of the extruded circular profile, creating a bubble. The air can expand the extruded circular cross section by a multiple of the die diameter. This ratio is called the "blow-up ratio." When using a blown film process, the manufacturer can collapse the film to double the plies of the film. Alternatively, the manufacturer can cut and fold the film, or cut and leave the film unfolded.

Referring to FIG. 1, an embodiment of a flexible multi-layered thermoplastic bag 100 is illustrated. While flexible bags are generally capable of holding a vast variety of different contents, the multi-layered bag 100 illustrated in FIG. 1 may be intended to be used as a liner for a garbage can or similar refuse container. The multi-layered bag 100 can include first sidewall 102 and an opposing second sidewall 104 overlying the first sidewall to provide an interior volume 106 therebetween. The first and second sidewalls 102, 104 may be joined along a first side edge 110, a parallel or non-parallel second side edge 112, and a bottom edge 114. The bottom edge 114 that may extend between the first and second side edges. The sidewalls 102, 104 may be joined along the first and second side edges 110, 112 and bottom edge 114 by any suitable process such as, for example, heat sealing. In one or more implementations, the closed bottom edge 114 can comprise a fold joining the first sidewall 102 to the second sidewall 104. Alternatively, the closed bottom edge can comprise a seal, such as a heat seal.

Figure 2:
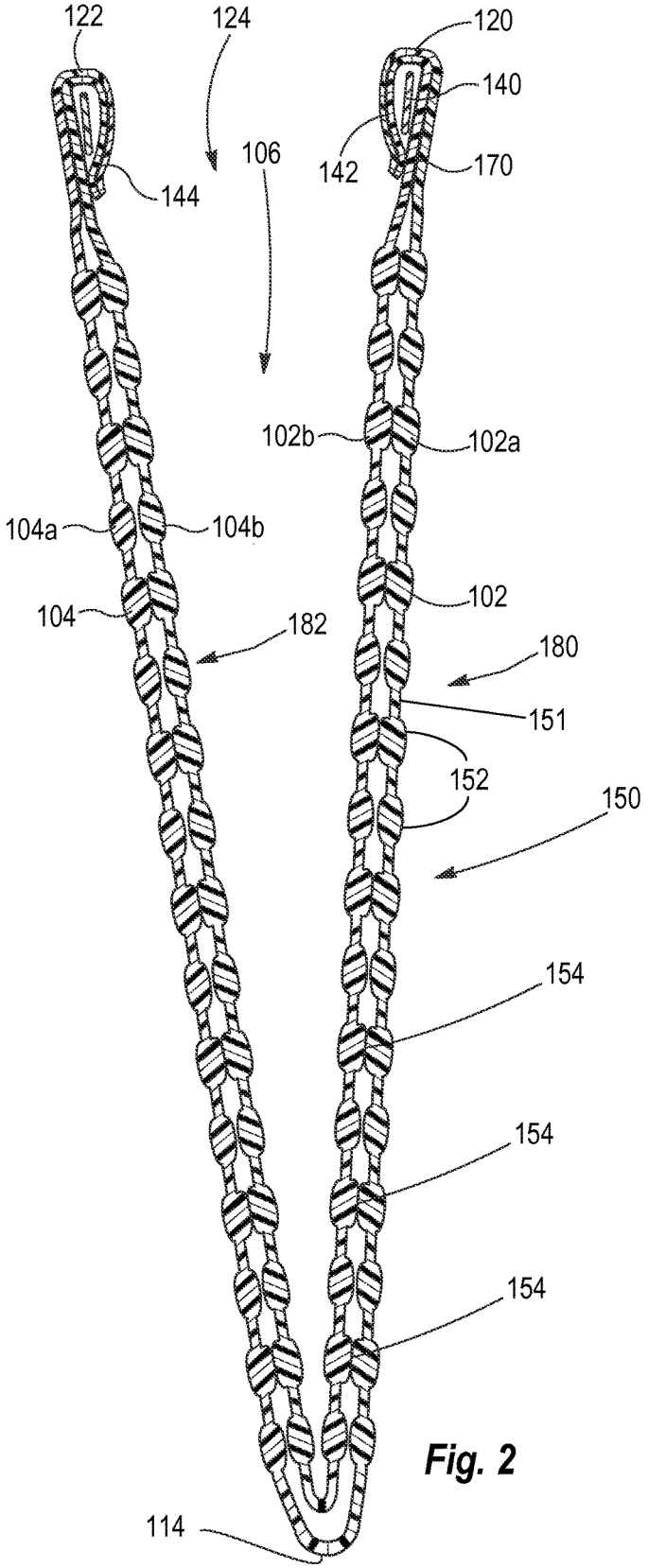
FIG. 2 illustrates a cross-sectional view of the multi-layered thermoplastic bag of FIG. 1 taken along line 2-2 of FIG. 1.

As shown by FIG. 2, each sidewall 102, 104 can comprise a multi-layer thermoplastic material in which the layers of each sidewall are non-continuously laminated together. In particular, the first sidewall 102 can comprise a first film layer 102*a* and a second film layer 102*b* non-continuously laminated together in at least one area, section, or portion. Similarly, the second sidewall 104 can comprise a first film layer 104*a* and a second film layer 104*b* non-continuously laminated together in at least one area, section, or portion.

The first and second sidewalls 102, 104 of the plastic multi-layered bag 100 may comprise a flexible or pliable thermoplastic material which may be formed or drawn into a web or sheet. When used as a garbage can liner, the thermoplastic material may be opaque but in other applications may be transparent, translucent, or tinted. Furthermore, the material used for the sidewalls may be a gas impermeable material.

To allow access to the interior volume 106, at least a portion of the top edges 120, 122 of the first and second sidewalls 102, 104 may remain un-joined to define an opening 124. The opening 124 can be located opposite the closed bottom edge 114. When placed in a trash receptacle, the top edges 120, 122 of the first and second sidewalls 102, 104 may be folded over the rim of the receptacle.

The multi-layered bag 100 may include a closure means for closing the opening 124. For example, FIGS. 1 and 2 illustrate that the multi-layered bag 100 can include a draw tape 140. To accommodate the draw tape 140, the first top edge 120 of the first sidewall 102 may be folded back into the interior volume 106 and attached at the hem seal 170 to the interior surface of the sidewall to form a first hem 142. Similarly, the second top edge 122 of the second sidewall 104 may be folded back into the interior volume and attached to the second sidewall to form a second hem 144. In other implementations, the hems may be folded to the exterior and attached to the exterior surface of the sidewall(s). In still further implementations, the draw tape 140 may be placed between the respective layers 102*a*, 102*b* and 104*a*, 104*b* of the first and second sidewalls 102, 104.

In such implementations, heat seals can bond the respective layers 102*a*, 102*b* and 104*a*, 104*b* together both above and below the draw tape 140.

The draw tape 140 may extend along the first and second top edge 120, 122 through the first and second hems 142, 144. First and second notches 146, 148 disposed through the respective first and second top edges 120, 122 can allow access to the draw tape 140. Pulling the draw tape 140 through the notches 146, 148 may constrict the top edges 120, 122 thereby closing the opening 124.

Referring to FIGS. 1 and 2, a ribbed pattern 150 in at least a portion of the first sidewall of the multi-layered bag 100 can provide desirable physical characteristics. The ribbed pattern 150 can comprise a plurality of alternating thin linear ribs 151 and thick linear ribs 152 that may extend across the first sidewall 102 substantially between the first side edge 110 and second side edge 112. As illustrated in FIG. 1, the ribs 151, 152 may be parallel and adjacent to one another. Additionally, as illustrated in FIG. 1, the ribbed pattern 150 may extend from the bottom edge 114 toward the opening 124. To avoid interfering with the operation of the draw tape 140, the extension of the ribbed pattern 150 may terminate below the hem seal 170, as illustrated by FIG. 1. In alternative implementations, the ribbed pattern can extend from the bottom edge 114 to the top edges of each sidewall.

FIG. 2 further illustrates that the inner layer 102*b*, 104*b* of each sidewall 102, 104 can be bonded to the outer layer 102*a*, 104*a*, of each sidewall 102, 104. In particular, a first plurality of non-continuous bonded regions or bonds 154 can secure the first and second layers 102*a*, 104*a*, 102*b*, 104*b* of the each sidewall together. Thus, the bonds 154 can comprise a pattern of linear bonds 154 extending between the first side edge 110 and the second side edge 112 of each sidewall 102, 104.

As shown by FIG. 2, in one or more implementations, the bonds 154 can bond thick linear ribs 152 of the inner layer 102*b*, 104*b* of each sidewall 102, 104 to thick linear ribs 152 of the outer layer 102*a*, 104*a* of each sidewall 102, 104. FIG. 2 illustrates that the bonds 154 can secure some, but not all, of the thick linear ribs 152 of one layer to the thick linear ribs 152 of an adjacent layer. In particular, FIG. 2 illustrates that bonds 154 can secure every other thick linear rib 152 of adjacent layers together. In alternative implementations, bonds 154 can secure each thick linear rib 152 of adjacent layer together. Additionally, in one or more implementations the thin linear ribs 151 may be unbounded.

In other words, as shown by FIG. 2, the multi-layered bag 100 can comprise a first layer 180 of thermoplastic material. The first layer 180 can include first and second side walls (i.e., 102*a* and 104*a*) joined along a bottom edge 114, a first side edge 110, and an opposing second side edge 112 as shown by FIG. 1. In one or more implementations, the bottom edge 114 of the first layer 180 can comprise a fold. The multi-layered bag 100 can also include a second layer of thermoplastic material 182. The second layer 182 can include first and second side walls (i.e., 102*b* and 104*b*) joined along a bottom edge, a first side edge, and an opposing second side edge. As shown by FIG. 2, the second layer 182 can be positioned within the first layer 180. Furthermore, the first layer 180 and the second layer 182 are non-continuously bonded to each other by bonds 154 in one or more regions or sections.

Such a configuration may be considered a "bag-in-bag" configuration. In other words the multi-layered bag 100 can include a second thermoplastic bag 182 positioned within a first thermoplastic bag 180. Each of the first and second bags 180, 182 can include a first pair of opposing sidewalls joined together along three edges. A plurality of non-continuous bonded regions 154 can secure the first and second thermoplastic bags together.

The multi-layered bag 100 may have a height 160 measured between the closed bottom edge 114 and the opening 124. The height 160 may have a first range of about 10 inches to 48 inches, a second range of about 24 inches to 40 inches, and a third range of about 27 inches to 36 inches. In one or more implementations, the height 160 may be about 27.4 inches. The hem seal 170 can be a distance 166 below the opening 124. The distance 166 can have a first range of about 1.0 inches to 4.0 inches, a second range of about 1.5 inches to 3.5 inches, and a third range of about 2.0 inches to 3.0 inches. In one or more implementations, the distance 166 may be about 2.25 inches. The ribbed pattern 150 can start a distance 164 below the hem seal 170. The distance 164 can have a first range of 0.25 inches to 8.0 inches, a second range of 0.25 inches to 4.0 inches, a third range of 0.5 inches to 2.0 inches. In one or more implementations, the distance 164 may be about 1.0 inches. Thus, in one or more implementations, a portion of the multi-layered bag 100 adjacent the opening 106 or hem seal 170 can be un-patterned. Such un-patterned portions can be devoid of ribs 152, and optionally, bonds 154.

In one or more implementations, through a pair of transverse direction intermeshing rollers can form the ribs 152 and/or bonds 154. As used herein, the term "machine direction" or "MD" refers to the direction along the length of the film, or in other words, the direction of the film as the film is formed during extrusion and/or coating. As used herein, the term "transverse direction" or "TD" refers to the direction across the film or perpendicular to the machine direction.

Figure 3:
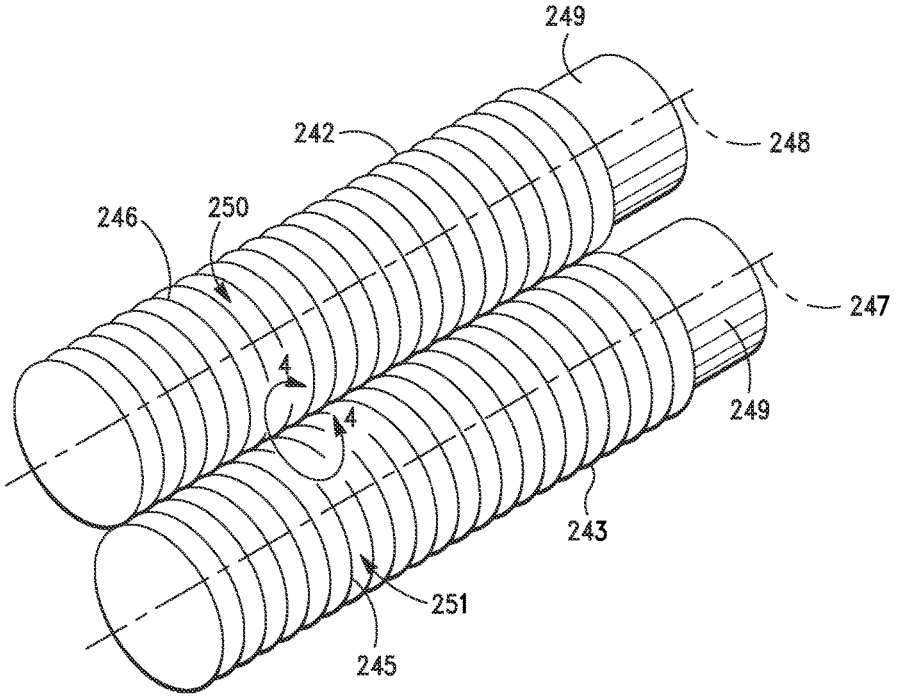
FIG. 3 illustrates a view of a pair of transverse direction intermeshing rollers for imparting a ribbed pattern into a film in accordance with one or more implementations of the present invention.

FIG. 3 illustrates an example of TD intermeshing rollers 242, 243. As shown by the FIG. 3, the first roller 242 and the second roller 243 can each have a generally cylindrical shape. The rollers 242, 243 may be made of cast and/or machined metal, such as, steel, aluminum, or any other suitable material. The rollers 242, 243 can rotate in opposite directions about parallel axes of rotation. For example, FIG. 3 illustrates that the first roller 242 can rotate about a first axis 248 of rotation in a counterclockwise direction. FIG. 3 also illustrates that the second roller 243 can rotate about a second axis 247 of rotation in a clockwise direction. The axes of rotation 248, 247 can be parallel to the transverse direction TD and perpendicular to the machine direction MD.

Figure 4:
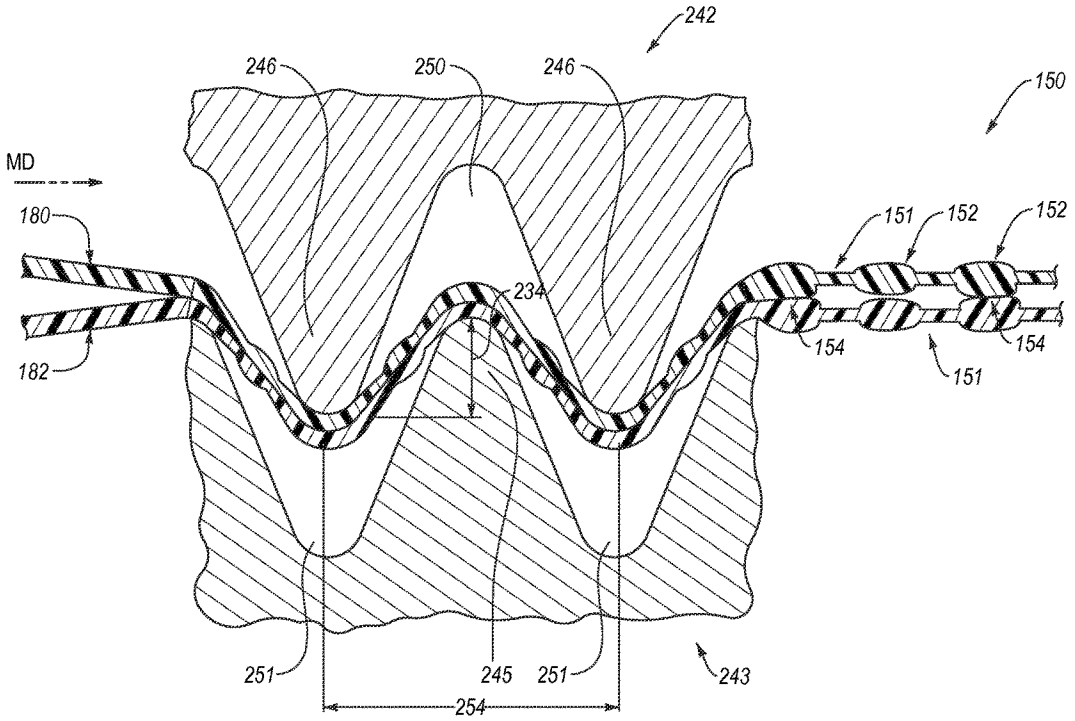
FIG. 4 illustrates an enlarged view of two initially separate thermoplastic films passing together through the transverse direction intermeshing rollers of FIG. 3 taken along the circle 4 of FIG. 3.

The intermeshing rollers 242, 243 can closely resemble fine pitch spur gears. In particular, the rollers 242, 243 can include a plurality of protruding ridges 246, 245. The ridges 246, 245 can extend along the rollers 242, 243 in a direction generally perpendicular to axes of rotation 248, 247 (i.e., in the machine direction). Furthermore, the ridges 246, 245 can extend generally radially outward from the axes of rotation 248, 247. The tips of ridges 246, 245 can have a variety of different shapes and configurations. For example, the tips of the ridges 246, 245 can have a rounded shape as shown in FIG. 4. In alternative implementations, the tips of the ridges 246, 245 can have sharp angled corners. FIG. 3 also illustrates that grooves 250, 251 can separate adjacent ridges 246, 245.

In one or more implementations, the rollers 242, 243 may include one or more portions that are smooth and devoid of ridges 246, 245 and grooves 250, 251. Such smooth portions can allow a manufacturer to selectively create ribs 152 and bonds 154 in desired portions or sections of a film or bag. For example, FIG. 3 illustrates that the TD intermeshing rollers can have smooth ends 249 to avert imparting a ribbed pattern onto a portion of the web that includes the draw tape, as explained below. In alternative implementations, other sections of the TD intermeshing rollers may be smooth.

The ridges 246 on the first roller 242 can be offset or staggered with respect to the ridges 245 on the second roller 243. Thus, the grooves 250 of the first roller 242 can receive the ridges 245 of the second roller 243, as the rollers 242, 243 intermesh. Similarly, the grooves 251 of the second roller 243 can receive the ridges 246 of the first roller 242. The configuration of the ridges 246, 245 and grooves 250, 251 can affect the amount of stretching and the bond strength resulting from partially discontinuous lamination as the films pass through intermeshing rollers 242, 243.

Referring specifically to FIG. 4, various features of the ridges 246, 245 and grooves 250, 251 are shown in greater detail. The pitch and depth of engagement of the ridges 246, 245 can determine, at least in part, the amount of incremental stretching and partially discontinuous lamination caused by the intermeshing rollers 242, 243. As shown by FIG. 4, the pitch 254 is the distance between the tips of two adjacent ridges on the same roller. The "depth of engagement" ("DOE") 234 is the amount of overlap between ridges 246, 245 of the different rollers 242, 243 during intermeshing.

The ratio of DOE 234 to pitch 254 can determine, at least in part, the bond strength of bonds 154 created by the TD intermeshing rollers. According to one implantation, the ratio of DOE to pitch provided by any ring rolling operation is less than about 1.1:1, suitably less than about 1.0:1, suitably between about 0.5:1 and about 1.0:1, or suitably between about 0.8:1 and about 0.9:1.

FIG. 4 further illustrates the creation of ribs 151, 152 and bonds 154 as two separate films 180, 182 pass through the TD intermeshing rollers 242, 243. In particular, as the thermoplastic films 180, 182 pass between the TD intermeshing rollers 242, 243, the ridges 246, 245 can incrementally stretch the films 180, 182 in the transverse direction. In one or more implementations, stretching the films 180, 182 in the transverse direction can reduce the average gauge of the films and increase the width of the films 180, 182.

In particular, as the films 180, 182 proceed between the TD intermeshing rollers 242, 243, the ridges 246 of the first roller 242 can push the films 180, 182 into the grooves 251 of the second roller 243 and vice versa. The pulling of the films 180, 182 by the ridges 246, 245 can stretch the films 180, 182. The rollers 242, 243 may not stretch the films 180, 182 evenly along their length. Specifically, the rollers 242, 243 can stretch the portions of the films 180, 182 between the ridges 246, 245 more than the portions of the films 180, 182 that contact the ridges 246, 245, or vice versa. Thus, the rollers 242, 243 can impart or form a ribbed pattern 150 into resultant multi-layered film. As used herein, the terms "impart" and "form" refer to the creation of a desired structure or geometry in a film upon stretching the film that will at least partially retain the desired structure or geometry when the film is no longer subject to any strains or externally applied forces.

The TD intermeshing rollers 242, 243 can form thick ribs 152, thin ribs 151, and bonds 154 in the films 180, 182. In one or more implementations, the adjacent thick ribs 152 of the films 180, 182 can be joined by bonds 154. In addition to forming ribs 151, 152 and bonds 154, TD ring rolling the films 180, 182 can increase or otherwise modify one or more of the tensile strength, tear resistance, impact resistance, or elasticity of the films 180, 182, in addition to whatever additional strength is provided by the partially discontinuous, bonds 154 between adjacent layers.

To the extent that TD or other ring rolling is used to lightly bond the films 180, 182, the ribbed pattern 150 (e.g., width and spacing of the ribs 151, 152) can depend on the pitch 254 of the ridges 246, 245, the DOE 234, and other factors. As portions of the films 180, 182 including a ribbed pattern 150 also represent areas of the multi-layer film in which the adjacent layers are non-continuously bonded to one another, it will be apparent that altering the spacing and/or width of ribs 151, 152 can affect the overall strength of the film. For example, providing more bonded surface area relative to the unbonded surface area can increase the density of such bonds 154 that can absorb forces, increasing the film strength.

Figure 5:
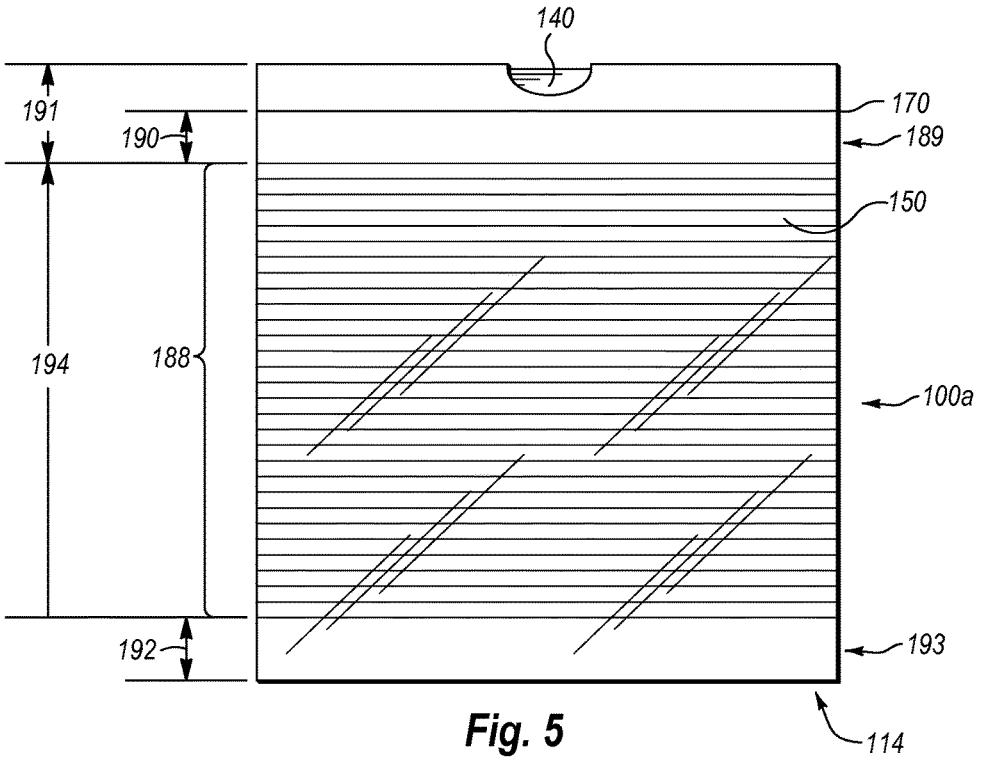
FIG. 5 illustrates a front elevational view of a non-continuously laminated multi-layered bag with a ribbed pattern in accordance with one or more implementations of the present invention.

Referring now to FIG. 5, another implementation of a multi-layered bag 100*a* for use as a trash receptacle liner is illustrated. The multi-layered bag 100*a* may be similar to the multi-layered bag 100, albeit that a bottom portion of the multi-layered bag 100*a* proximate the bottom edge 114 is un-patterned (i.e., devoid of ribs 152), and optionally also un-bonded (i.e., devoid of bonds 154).

Thus, the area or portion 188 including the ribbed pattern 150 is separated from the hem seal 170 by a first, upper un-patterned portion or area 189. The upper un-patterned portion 189 can extend a distance 190 below the hem seal 170 or a distance 191 from the bag top. In one or more implementations as shown by FIG. 5, the ribbed patterned area 188 also does not reach to the bag bottom 114 but is a distance 192 from the bag bottom 114. Thus, the multi-layered bag 100*a* includes a second, bottom un-patterned (and optionally un-laminated) portion 193. The ribbed patterned area 188 can extend a distance 194 from top to bottom. Additionally, ribbed patterned area 188 can extend across the entire width of the bag.

The distance 191 can have a first range of about 1.0 inches to 8.0 inches, a second range of about 1.5 inches to 4.0 inches, and a third range of about 2.0 inches to 3.0 inches. In one or more implementations, the distance 191 may be about 2.5 inches. The distance 190 can have a first range of 0.25 inches to 7.0 inches, a second range of 0.25 inches to 4.0 inches, a third range of 0.5 inches to 2.0 inches. In one or more implementations, the distance 190 may be about 1.0 inches. The distance 192 can have a first range of 0.25 inches to 12.0 inches, a second range of 0.5 inches to 8.0 inches, a third range of 0.5 inches to 4.0 inches. In one or more implementations, the distance 192 may be about 4.0 inches. The distance 194 can have a first range of 1.0 inches to 22.0 inches, a second range of 12.0 inches to 21.0 inches, a third range of 14.0 inches to 20.0 inches, and a fourth range of 4.0 to 7.0 inches. In one or more implementations, the distance 194 may be about 21.0 inches.

Figure 6:
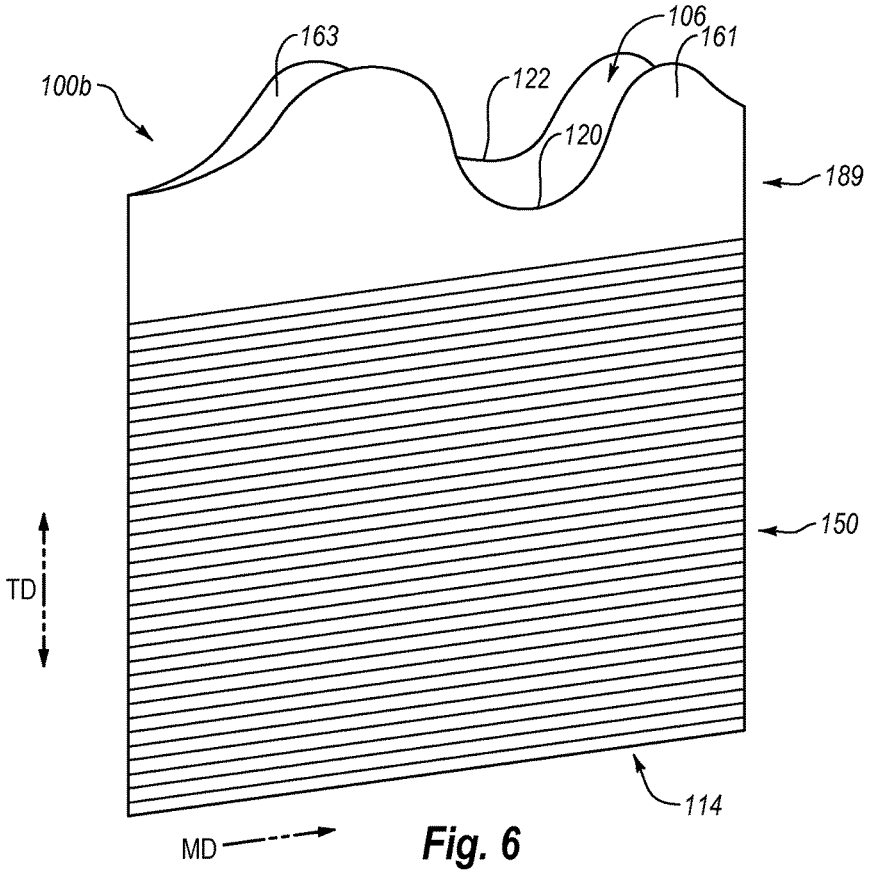
FIG. 6 illustrates a view of another non-continuously laminated multi-layered bag with a ribbed pattern in accordance with one or more implementations of the present invention.

The multi-layered bags 100, 100*a* shown and described hereinabove have each include a draw tape as a closure means. One will appreciate in light of the disclosure herein that the present invention is not so limited. In alternative implementations, the closure means can comprise flaps, adhesive tapes, a tuck and fold closure, an interlocking closure, a slider closure, a zipper closure or other closure structures known to those skilled in the art for closing a bag. For example, FIG. 6 illustrates a multi-layered bag 100*b* similar to the multi-layered bag 100 of FIG. 1, albeit that the multi-layered bag 100*b* includes flaps 161, 163 as closure means instead of a draw tape 140.

Figure 7:
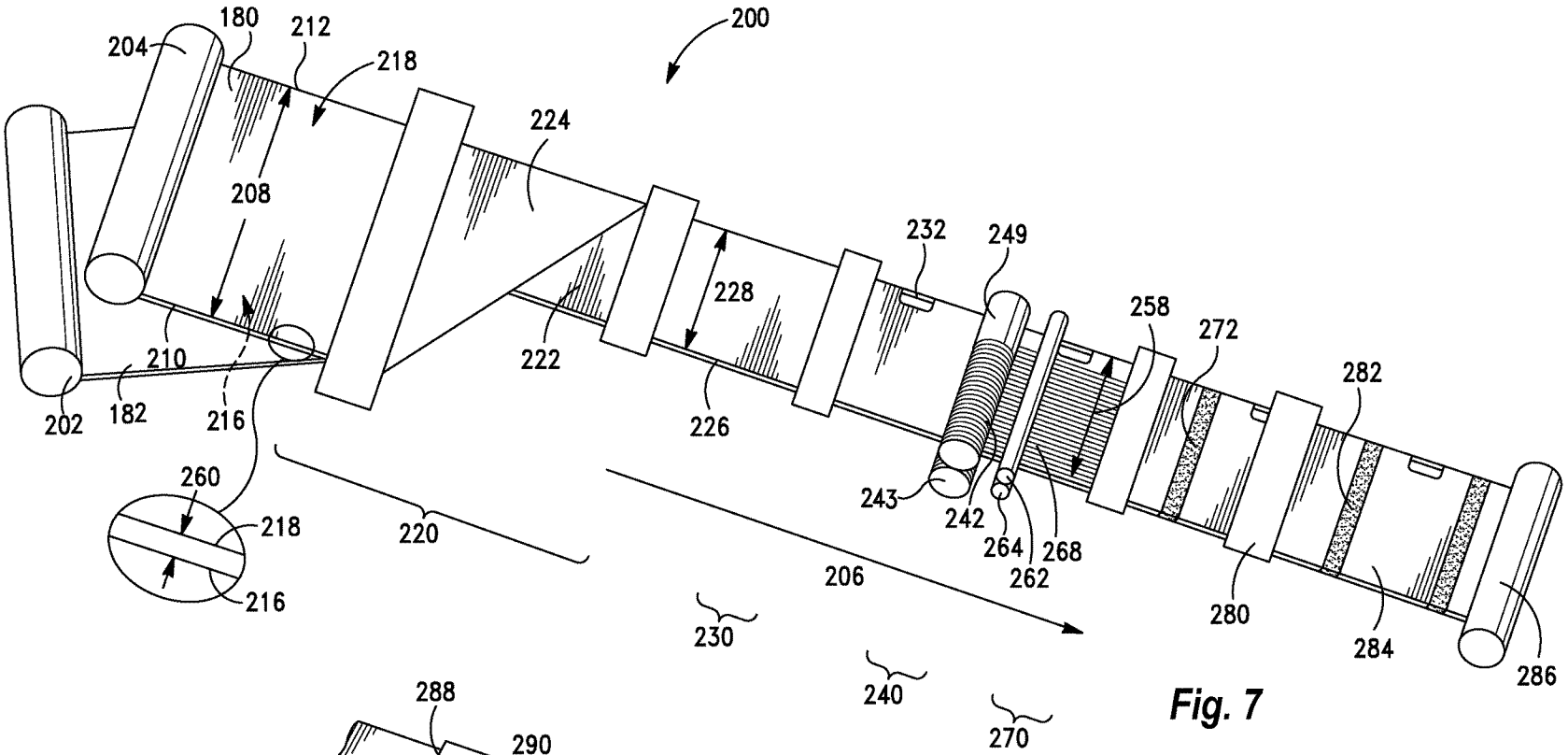
FIG. 7 illustrates a schematic view depicting a high-speed manufacturing process for producing multi-layered thermoplastic bags having ribbed patterns in accordance with one or more implementations of the present invention.

To produce a bag having a ribbed pattern as described, continuous webs of thermoplastic material may be processed through a high-speed manufacturing environment such as that illustrated in FIG. 7. In the illustrated process 200, production may begin by unwinding a first continuous web or film 180 of thermoplastic sheet material from a roll 204 and advancing the web along a machine direction 206. The unwound web 180 may have a width 208 that may be perpendicular to the machine direction 206, as measured between a first edge 210 and an opposite second edge 212. The unwound web 180 may have an initial average thickness measured between a first surface 216 and a second surface 218. In other manufacturing environments, the web 180 may be provided in other forms or even extruded directly from a thermoplastic forming process. The process 200 can also involve unwinding a second continuous web or film 182 of thermoplastic sheet material from a roll 202 and advancing the web along a machine direction 206. The second film 182 can comprise a thermoplastic material, a width, and/or a thickness that is similar or the same as the first film 180. In alternative one or more implementations, one or more of the thermoplastic material, width, and/or thickness of the second film 182 can differ from that of the first film 180.

To provide the first and second sidewalls of the finished bag, the webs 180, 182 may be folded into a first half 222 and an opposing second half 224 about the machine direction 206 by a folding operation 220. When so folded, the first edge 210 may be moved adjacent to the second edge 212 of the web. Accordingly, the width of the webs 180, 182 proceeding in the machine direction 206 after the folding operation 220 may be a width 228 that may be half the initial width 208. As may be appreciated, the portion mid-width of the unwound webs 180, 182 may become the outer edge of the folded web. In any event, the hems may be formed along the adjacent first and second edges 210, 212 and the draw tape 232 may be inserted during a hem and draw tape operation 230.

To impart the ribbed pattern 150 (and optionally the bonds 154), the processing equipment may include TD intermeshing rollers 242, 243 such as those described herein above. Referring to FIG. 7, the folded webs 180, 182 may be advanced along the machine direction 206 between the TD intermeshing rollers 242, 243, which may be set into rotation in opposite rotational directions to impart the resulting web pattern 150. To facilitate patterning of the webs 180, 182, the first roller 242 and second roller 243 may be forced or directed against each other by, for example, hydraulic actuators. The pressure at which the rollers are pressed together may be in a first range from 30 PSI (2.04 atm) to 100 PSI (6.8 atm), a second range from 60 PSI (4.08 atm) to 90 PSI (6.12 atm), and a third range from 75 PSI (5.10 atm) to 85 PSI (5.78 atm). In one or more implementations, the pressure may be about 80 PSI (5.44 atm).

In the illustrated implementation, the TD intermeshing rollers 242, 243 may be arranged so that they are co-extensive with or wider than the width 208 of the folded webs 180, 182. In one or more implementations, the TD intermeshing rollers 242, 243 may extend from proximate the outer edge 226 to the adjacent edges 210, 212. To avert imparting the ribbed pattern 150 onto the portion of the web that includes the draw tape 232, the corresponding ends 249 of the rollers 242, 243 may be smooth and without the ridges and grooves. Thus, the adjacent edges 210, 212 and the corresponding portion of the web proximate those edges that pass between the smooth ends 249 of the rollers 242, 243 may not be ribbed.

In one or more implementations, the webs 180, 182 may be stretched to reduce their thickness as they passes between the rollers. Referring to FIG. 7, the webs 180, 182, when unwound from the rolls 202, 204, may have an average thickness 260, measured between the first surface 216 and a second surface 218. The average thickness 260 may have a first range of about 0.0003 inches to 0.0014 inches, a second range of about 0.0004 inches to 0.0012 inches, and a third range of about 0.0005 inches to 0.0011 inches. In one or more implementations, the average thickness may be 0.0006 inches. After passing between the TD intermeshing rollers 242, 243, the web may have an average thickness that is reduced. The reduced average thickness may be in a first range of about 0.0001 inches to 0.0012 inches, a second range of 0.0002 inches to 0.0009 inches, and a third range of about 0.0003 inches to 0.0008 inches. In one or more implementations, the reduced average thickness may be about 0.0004 inches. The reduced average thickness may be 85% or less of the original average thickness, or to 90% or less of the first average thickness, or to 80% or less of the first average thickness, or to 70% or less of the first average thickness. Of course, other reductions in average thickness may be possible and may be achieved by varying the initial average thickness of the web, by adjusting spacing of the rollers, and by adjusting the pressure at which the rollers are pressed or forced together.

One result of reducing the thickness of the web material is that the ribbed pattern 150 may be imparted into the web(s) 180, 182. The thermoplastic material of the web may be stretched or worked during reduction such that the initially planar web takes the new ribbed shape. In some implementations, the molecular structure of the thermoplastic material may be rearranged to provide this shape memory. Furthermore, upon stretching, individual initially separate layers of the thermoplastic material of the web become non-continuously laminated together at, or proximate, the location of the ribs 152. In other words, at or adjacent the ribs 152, the adjacent layers 180, 182 are lightly bonded to one another, while adjacent portions are not bonded to one another.

Referring to FIG. 7, another result of reducing the web thickness is that some of the web material may be stretched longitudinally along the TD intermeshing rollers 242, 243 and perpendicular to the machine direction 206. Also, some of the web material may be compressed longitudinally along the TD intermeshing rollers 242, 243. This action may widen the folded web from its initial width 228 to a larger width 258. To facilitate the widening of the web, the adjacent edges 210, 212 of the web may be located between the smooth ends 249 of the TD intermeshing rollers 242, 243. The smooth ends 249 of the TD intermeshing rollers 242, 243 can maintain alignment of the web along the machine direction. The processing equipment may include pinch rollers 262, 264 to accommodate the growing width of the widening web.

The processed web may have varying thickness as measured along its width perpendicular of the machine direction. Because the ridges 246, 245 and the grooves 250, 251 on the TD intermeshing rollers 242, 243 may not be co-extensive with the width 228 of the folded webs 180, 182 only the thickness of that portion of the web which is directed between the ridges and the grooves may be reduced. The remaining portion of the web, such as, toward the adjacent edge 210, 212, may retain the web's original thickness. The smooth ends 249 of the TD intermeshing rollers 242, 243 may have diameters dimensioned to accommodate the thickness of that portion of the web which passes therebetween.

To produce the finished bag, the processing equipment may further process the folded web with the ribbed pattern. For example, to form the parallel side edges of the finished bag, the web may proceed through a sealing operation 270 in which heat seals 272 may be formed between the outer edge 226 and the adjacent edges 210, 212. The heat seals may fuse together the adjacent halves 222, 224 of the folded web. The heat seals 272 may be spaced apart along the folded web and in conjunction with the folded outer edge 226 may define individual bags. The heat seals may be made with a heating device, such as, a heated knife. A perforating operation 280 may perforate 282 the heat seals 272 with a perforating device, such as, a perforating knife so that individual bags 290 may be separated from the web. In one or more implementations, the webs may be folded one or more times before the folded webs may be directed through the perforating operation. The webs 180, 182 embodying the finished multi-layered bags 284 may be wound into a roll 286 for packaging and distribution. For example, the roll 286 may be placed in a box or a bag for sale to a customer.

Figure 8:
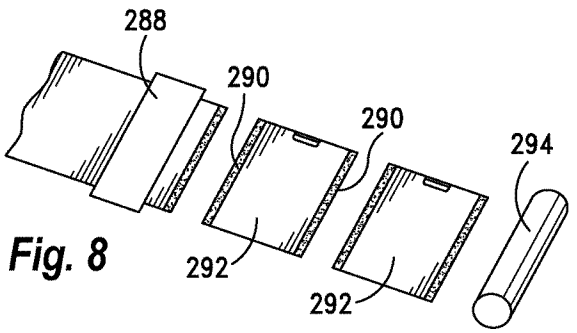
FIG. 8 illustrates a schematic view of the final steps of one or more implementations of the high-speed manufacturing process shown in FIG. 7.

In one or more implementations of the process which is illustrated in FIG. 8, a cutting operation 288 may replace the perforating operation 280 in FIG. 7. Referring to FIG. 8, the web are directed through a cutting operation 288 which cuts the webs at location 290 into individual bags 292 prior to winding onto a roll 294 for packaging and distribution. For example, the roll 294 may be placed in a box or bag for sale to a customer. The bags may be interleaved prior to winding into the roll 294. In one or more implementations, the web may be folded one or more times before the folded web is cut into individual bags. In one or more implementations, the bags 292 may be positioned in a box or bag, and not onto the roll 294. The bags may be interleaved prior to positioning in the box or bag. These manufacturing implementations may be used with any of the manufacturing implementations described herein, as appropriate.

Figure 9:
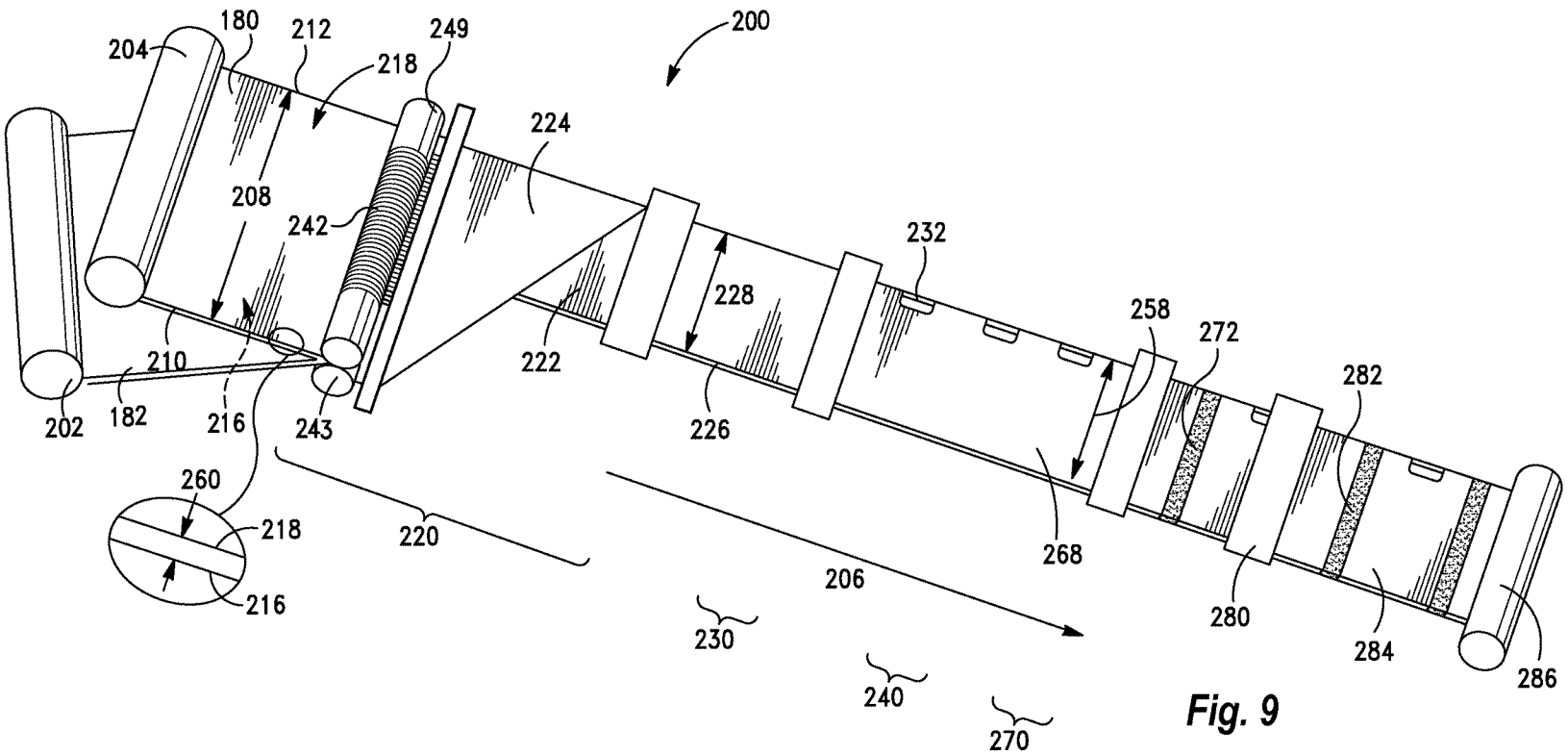
FIG. 9 illustrates a schematic view of another high-speed manufacturing process for producing multi-layered thermoplastic bags having ribbed patterns in accordance with one or more implementations of the present invention.

FIG. 9 illustrates another manufacturing process 200*a* for producing a multi-layered bag in accordance with one or more implementations of the present invention. The process 200*a* can be similar to process 200 of FIG. 7, except that the film layers 180, 182 may pass through the TD intermeshing rollers 242, 243 prior to the folding process 220. Furthermore, as shown by FIG. 9, the TD intermeshing rollers 242, 243 can include smooth portions 249 on each end. In alternative implementations, the TD intermeshing rollers 242, 243 can include smooth portions 249 in the middle of the rollers or intermittent smooth portions.

Figure 10:
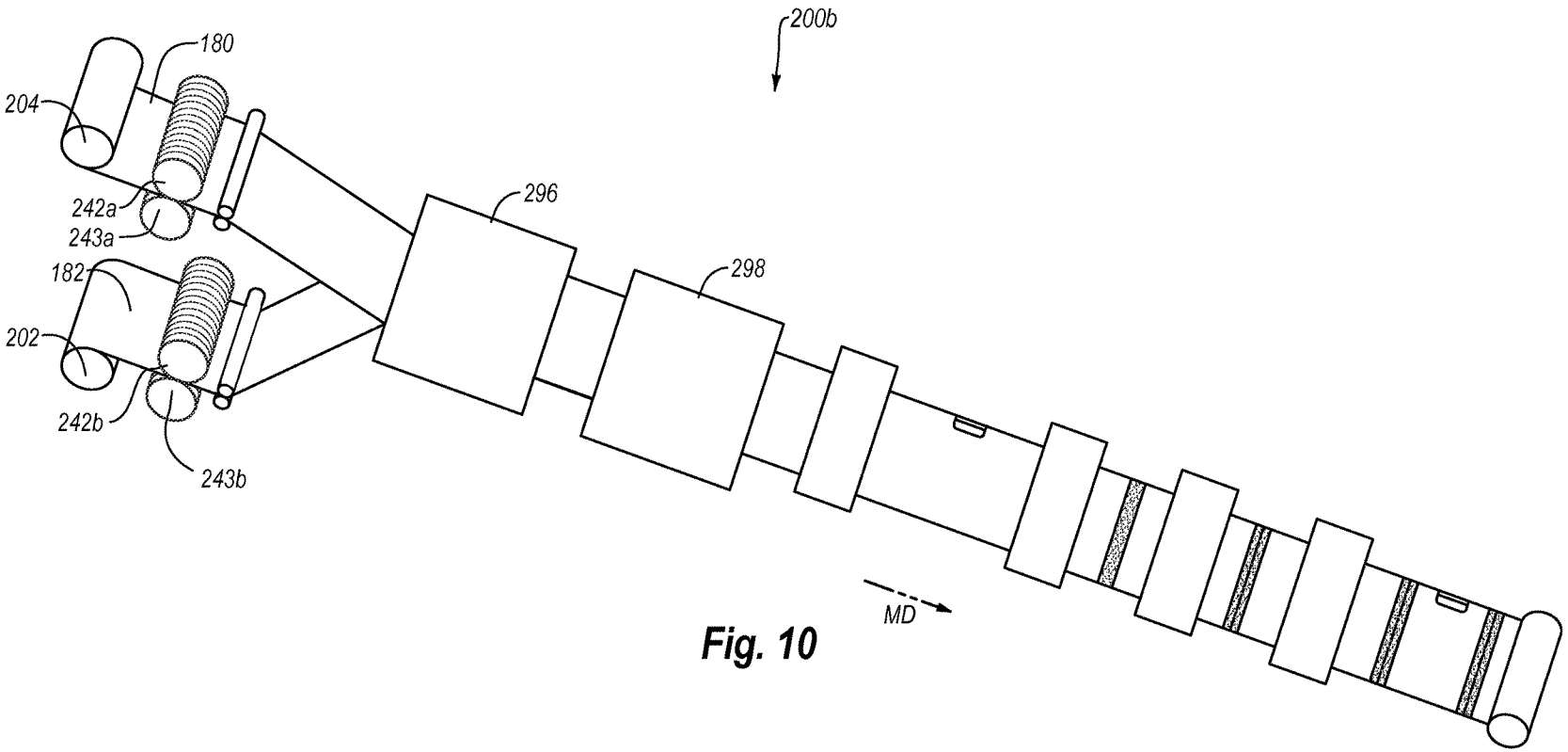
FIG. 10 illustrates a schematic view depicting yet another high-speed manufacturing process for producing multi-layered thermoplastic bags having ribbed patterns in accordance with one or more implementations of the present invention.

FIG. 10 illustrates another manufacturing process 200*b* for producing a multi-layered bag with increased strength and/or reduced material. The process 200*b* can be similar to process 200 of FIG. 7, except that the film layers 180, 182 are folded in half to form c-, u-, or j-folded films prior to winding on the rolls 202, 204. Thus, in such implementations, the films 180, 182 unwound from the rolls 202, 204 are already folded.

Additionally, the manufacturing process 200*b* illustrates that each film 180, 182 can pass through a set of TD intermeshing rollers 242*a*, 243*a*, 242*b*, 243*b* to incrementally stretch the films (and impart a ribbed pattern thereto) prior to bonding. The manufacturing process 200*b* can then include an insertion operation 296 for inserting the folded film 182 into the folded film 180. Insertion operation 296 can combine the folded films 180, 182 using any of the apparatus and methods described in U.S. patent application Ser. No. 13/225,757 filed Sep. 6, 2011 and entitled METHOD FOR INSERTING A FIRST FOLDED FILM WITHIN A SECOND FOLDED FILM and Ser. No. 13/225,930 filed Sep. 6, 2011 and entitled APPARATUS FOR INSERTING A FIRST FOLDED FILM WITHIN A SECOND C-FOLDED FILM, each of which are incorporated herein by reference in their entirety.

Additionally, FIG. 10 illustrates that the film layers 180, 182 can then pass through a lamination operation 298 to lightly bond or laminate the films 180, 182 together. Lamination operation 298 can lightly laminate the folded films 180, 182 together via adhesive bonding, pressure bonding, ultrasonic bonding, corona lamination, and the like. Alternatively, lamination operation 298 can lightly laminate the folded films 180, 182 together by passing them through machine-direction ring rolls, transverse-direction ring rolls, diagonal-direction ring rolls, SELF'ing rollers, embossing rollers, or other intermeshing rollers.

A possible advantage of imparting the ribbed pattern onto the sidewall of the finished bag is that toughness of the thermoplastic bag material may be increased. For example, toughness may be measured by the tensile energy to yield of a thermoplastic film or web. This measure represents the energy that the web material may incur as it is pulled or placed in tension before it yields or gives way. The tensile energy to yield quality can be tested and measured according to various methods and standards, such as those set forth in ASTM D882-02, herein incorporated by reference in its entirety.

In particular, a web, which is processed to have a ribbed pattern imparted onto it by rollers, may demonstrate a higher tensile energy to yield in the transverse direction, which is perpendicular to the machine direction according to which the web is processed. By way of example only, a linear low density polyethylene web having an initial average thickness of 0.0009 inches (0.0023 cm) was run between a pair of rollers having circular ridges at a 0.04 inch (0.1 cm) pitch, a DOE of 0.035 inches (0.09 cm), a roller pressure of 60 PSI (4.08 atm), and a speed of 300 feet per minute (91.4 meters per minute). The web had an initial tensile yield of 1.50 lbf. (6.7 N) in the transverse direction and an initial tensile energy to yield of 0.274 in-lbf (0.031 J) in the transverse direction. After imparting the ribbed pattern, the web had a tensile yield of 1.43 lbf (6.36 N), a tensile energy to yield of 0.896 in-lbf (0.101 J) and an average thickness of 0.00077 inches (0.002 cm). Thus a substantial increase in TD tensile energy to yield can be achieved with almost no decrease in TD tensile yield. The following table sets forth the change in these values.

TABLE 1

| Characteristic/Material | Initial Unprocessed Web | Processed Web |
|---|---|---|
| TD Tensile Yield | 1.50 lbf (6.67N) | 1.43 lbf (6.36N) |
| TD Tensile Energy To Yield | 0.274 in-lbf (0.031 J) | 0.896 in-lbf (0.101 J) |

By way of further example, a different linear low density polyethylene web having an initial average thickness of 0.0008 inches (0.002 cm) mils was run between a pair of rollers having circular ridges at a 0.04 inch (0.1 cm) pitch and a DOE of 0.02 inches (0.051 cm), a roller pressure of 60 PSI (4.08 atm), and a speed of 300 feet per minute (91.4 meters per minute). The web had an initial tensile yield of 1.39 lbf (6.18 N) in the transverse direction and an initial tensile energy to yield of 0.235 in-lbf (0.027 J) in the transverse direction. After imparting the ribbed pattern, the web had a tensile yield of 1.38 lbf (6.14 N) and a tensile energy to yield of 0.485 in-lbf (0.055 J) and an average thickness of 0.00075 inches (0.0019 cm). The following table sets forth the change in these values.

TABLE 2

| Characteristic/Material | Initial Unprocessed Web | Processed Web |
|---|---|---|
| TD Tensile Yield | 1.39 lbf (6.18N) | 1.38 lbf (6.14N) |
| TD Tensile Energy to Yield | 0.235 in-lbf (0.027 J) | 0.485 in-lbf (0.055 J) |

Thus, imparting the ribbed pattern onto the thermoplastic web may increase the tensile energy to yield by a factor of 2 or greater without a substantial decrease in the tensile yield. When a thermoplastic bag may be manufactured according to the process set forth in FIG. 4, it may be appreciated that the transverse direction of the processed web corresponds to the bag length measured between the closed bottom end and the opened top end. Thus, the toughness of the bag may be increased in the lengthwise direction. The lengthwise direction may be the lift direction of the bag.

Another possible advantage of reducing the thickness of the web via imparting the web with a ribbed pattern is that the ultimate tensile strength may remain relatively consistent even though the web thickness might be reduced. For example, a thermoplastic web having an initial average thickness of 0.0012 inches (0.003 cm) and an ultimate tensile load of about 6.2 lbf (27.6 N) was processed between rollers to impart a ribbed pattern such as those described herein. The web was run between a pair of rollers having circular ridges at a pitch of 0.04 inches (0.1 cm), a depth of engagement of 0.045 inches (0.114 cm), a roller pressure of 40 PSI (2.72 atm), and a speed of 300 feet per minute (91.4 meters per minute). The processed film had an average thickness of about 0.00073 inches (0.00185 cm) and an ultimate tensile load of about 5.8 lbf (25.8 N). The results are set forth in the following table.

TABLE 3

| Material/Characteristic | Average Thickness | Ultimate Tensile Load |
|---|---|---|
| Initial Unprocessed Web | 0.0012 inches (0.003 cm) | 6.2 lbf (27.6N) |
| Processed Web | 0.00073 inches (0.00185 cm) | 5.8 lbf (25.8N) |

Another example of the advantages of reducing the thickness of the web without significantly altering the transverse ultimate tensile strength is shown for a web having an initial average thickness of 0.0009 inches (0.0023 cm) and an ultimate tensile load of about 4.8 lbf (21.4 N). The web was processed between rollers to impart a ribbed pattern such as those described herein. The web was run between a pair of rollers having circular ridges at a pitch of 0.04 inches (0.1 cm), a depth of engagement of 0.03 inches (0.076 cm), a roller pressure of 80 PSI (5.44 atm), and a speed of 300 feet per minute (91.4 meters per minute). The processed web had an average thickness of about 0.00073 inches (0.00185 cm) and an ultimate tensile strength of 4.4 lbf (19.6 N). The results are set forth in the following table.

TABLE 4

| Material/Characteristic | Average Thickness | Ultimate Tensile Load |
|---|---|---|
| Initial Unprocessed Web | 0.0009 inches (0.0023 cm) | 4.8 lbf (21.4N) |
| Processed Web | 0.00073 inches (0.00185 cm) | 4.4 lbf (19.6N) |

As may be appreciated, even though the average thickness of the 0.0012 inches (0.003 cm) web was reduced by almost 40% from its original average thickness, the ultimate tensile load was only reduced about 6.5%. While the 0.0009 inches (0.0023 cm) average thickness web was reduced by almost 25% from its original average thickness, the ultimate tensile load was only reduced about 8.3%. The comparison between the processed 0.0012 inches (0.003 cm) web and 0.0009 inches (0.0023 cm) web which both were processed to an average thickness of about 0.00073 inches (0.00185 cm), show that the ultimate tensile strength of the processed web is directly related to the initial unprocessed web's ultimate tensile strength. Imparting the ribbed pattern to the web reduces the average thickness in a range of about 5% to 40%, with a corresponding reduction in ultimate tensile load of about 0% to 8.3%. Thus, the ultimate tensile load of the web processed with a ribbed pattern remains substantially consistent with its initial unprocessed web despite having its average thickness reduced.

In addition to the above results, it has also been noticed that imparting the ribbed pattern to the webs made into thermoplastic bags alters the tear resistance of the web. The tear resistance of a thermoplastic web may be measured according to the methods and procedures set forth in ASTM D882-02, herein incorporated by reference in its entirety. By way of example only, a polyethylene web typically has a greater resistance to tear in the transverse direction that is perpendicular to the machine direction in which the web is processed. This web is characterized as having properties imbalanced in the machine direction. However, after passing the web between rollers to impart the ribbed pattern, the tear resistance may be changed. The web may become more balanced where the transverse and machine direction tear resistances may be about equal. Or it may experience greater change to become imbalanced in the transverse direction, where the tear resistance may be switched such that the tear resistance may be greater in the machine direction than in the transverse direction.

Further increases in strength may be achieved where the sidewalls are formed of a multi-layer thermoplastic material, as the ribbed pattern includes bonded portions where the adjacent layers become lightly bonded to one another, spaced apart by adjacent unbonded regions between the ribs. Because the bonding is light, when a force is applied, the force can be absorbed in breaking the light bond rather than puncture or tearing of the sidewall. This is beneficial as it has been found that thermoplastic films often exhibit strength characteristics that are approximately equal to the strength of the weakest layer. Providing relatively weak bonding between adjacent layers has surprisingly been found to greatly increase the strength provided by a given multilayer thermoplastic film. Strength is greater than a multi-layer film including separate layers, and also greater than a multi-layer film in which the layers are tightly bonded together. Preferably the bond strength is less than a tear strength of the weakest layer, so that the bond fails prior to failure of the weakest layer of the film. This increased strength as a result of non-continuous lamination is in addition to strength increases provided in individual layers as a result of ring rolling.

As more explicitly covered in U.S. patent application Ser. No. 12/947,025 filed Nov. 16, 2010 and entitled DISCONTINUOUSLY LAMINATED FILM, incorporated by reference herein, the MD and TD tear values of non-continuously laminated films in accordance with one or more implementations can exhibit significantly improved strength properties, despite a reduced gauge. In particular, the individual values for the Dynatup, Md. tear resistance, and TD tear resistance properties in non-continuously laminated films of one or more implementations are unexpectedly higher than the sum of the individual layers. Thus, the incrementally-stretched adhesively-laminated films provide a synergistic effect.

More specifically, the TD tear resistance of the incrementally-stretched non-continuously laminated films can be greater than a sum of the TD tear resistance of the individual layers (or the un-patterned, un-laminated areas, such as 189 and 193). Similarly, the MD tear resistance of the incrementally-stretched non-continuously laminated films can be greater than a sum of the MD tear resistance of the individual layers. Along related lines, the Dynatup peak load of the incrementally-stretched non-continuously laminated films can be greater than a sum of a Dynatup peak load of the individual layers. Thus, the incrementally-stretched non-continuously laminated films can provide a synergistic effect. In addition to the foregoing, one or more implementations of an incrementally-stretched non-continuously laminated film can allow for a reduction in basis weight (gauge by weight) as much as 50% and still provide enhanced strength parameters.

Additionally, as described herein, applying the ribbed pattern to just a portion of the web width may result in widening the web. For example, a web may have an initial width of 22.375 inches (56.8 cm) and an initial average thickness of about 0.0014 inches (0.0036 cm). The web may be passed between two rollers such as those described herein which may have ridges and grooves that may be 16.375 (41.6 cm) inches in length. The rollers may be arranged so that the average thickness of the web may be reduced from 0.0014 inches (0.0036 cm) to about 0.0009 inches (0.0023 cm) for that portion passed between the ridges and grooves. The reduction in average thickness may be accompanied by displacement in the web material such that the overall width of the web may expand to about 29.875 inches (75.9 cm), i.e. an increase of about 7.5 inches (19.1 cm). Thus, referring back to FIG. 1, a finished multi-layered bag 100 made from the processed web may have a greater height measured between the opening 124 and the closed bottom edge 114.

Additionally, as also described herein, because only that portion of the web which passes between the ridges and grooves may have its average thickness reduced, the remaining portion of the web (i.e., the un-patterned portion(s)), which is made into the bag may remain at the original average thickness of 0.0014 inches (0.0036 cm). The processing equipment may be arranged so that the thicker web material may correspond to those portions of the finished bag in which thicker material is advantageous.

Figure 11:
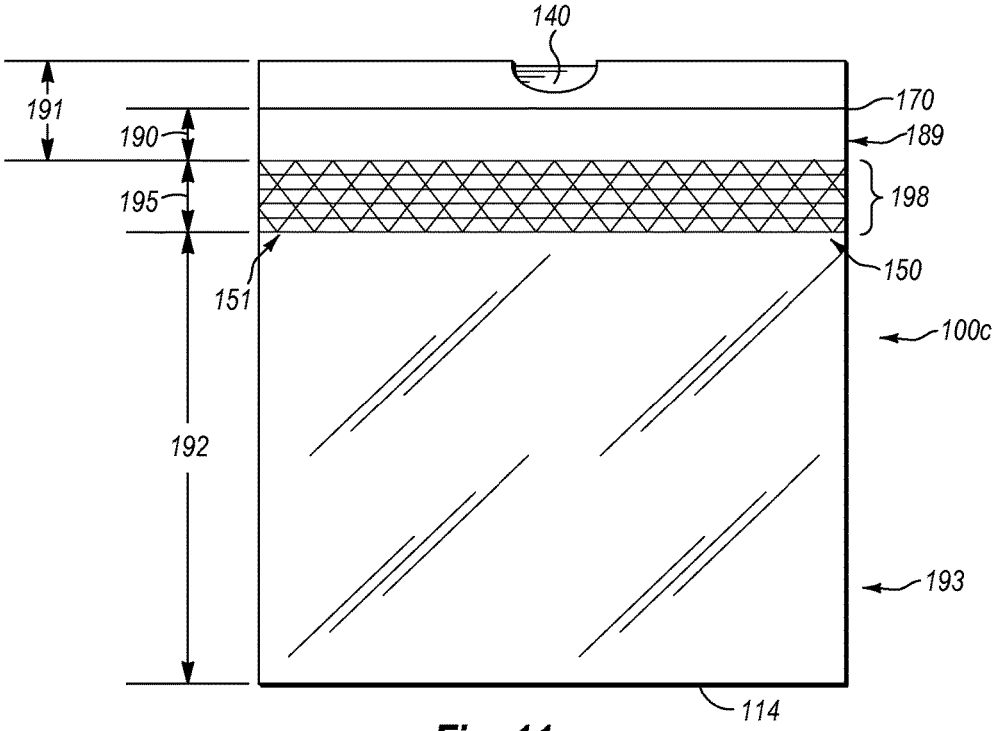
FIG. 11 illustrates a view of another non-continuously laminated multi-layered bag with a ribbed and network pattern in accordance with one or more implementations of the present invention.

For example, referring to FIG. 1, the portion of the web which does not pass through the ridges and grooves may correspond to the top portion of the bag which may include the draw tape 140. Thus, the top portion of the bag may be reinforced by the thicker material, or may at least be perceived to be stronger by the user as a result of the greater thickness. Where thickness reduction is particularly great, the top portion of the bag may actually have strength characteristics particularly suited to its use (e.g., wrapping around the rim of a trash can) that may be different than those strength characteristics provided by ring rolling and that would be advantageous in the bottom portion of the bag. In other implementations, the web may be processed so that the thicker material may be directed to other portions of the finished bag, such as the bottom portion shown in FIGS. 5, 11, and/or, that may otherwise be susceptible to rupture and/or puncture. Similarly, in one or more implementations, an upper portion of a bag as shown in FIGS. 6 and 11 can be un-patterned and thus include thicker material.

A possible advantage may result from arranging the ribbed pattern as a plurality of parallel, linear ribs and only along a portion of the width of the web. In the manufacturing process illustrated in FIG. 7, because the ribbed pattern may be imparted by directing the adjacent web halves 222, 224 between the TD intermeshing rollers 242, 243, the ribbed web halves may have a tendency to interlock together. Because the adjacent edges 210, 212 of the web 180 may be un-patterned; however, the web halves 222, 224 may be easily separated at the edges in a manner that may provide an impetus for separating a remainder of the web halves.

This may be particularly helpful where each web half itself includes two or more layers, which become discontinuously laminated together. By pulling each web half apart from one another, any lamination of the interior layers to one another (which may make opening the bag somewhat difficult) can be undone without damaging the lamination between individual layers of each respective web half.

Additionally, the parallel linear arrangement of ribs may facilitate unlocking the web halves. Thus, as may be appreciated, it may be easier to open a finished bag for use as a trash receptacle liner. In one or more implementations, the ribs are formed directly by extrusion and there is no difference in thickness compared to the flat extruded film. The ribbed pattern may be a plurality of extruded ribs disposed substantially laterally between opposite side edges where the ribs have a sinusoidal rounded cross-section.

Referring now to FIG. 11, there is illustrated another implementation of a multi-layered bag 100*c* for use as a trash receptacle liner. The multi-layered bag 100*c* may be similar to the multi-layered bag 100*a* of FIG. 5, albeit that the multi-layered bag 100*c* can include a network pattern area or portion 198. A network pattern may be formed in a variety of ways, for example forming a strainable network, embossing or printing. The network patterned area may exhibit a variety of functional properties. The network pattern area may be continuous across the width of the bag or discontinuous across the width of the bag. Though not bound by theory, the continuous network pattern may have advantages, for example gripping, over an un-patterned area. Though not bound by theory, the discontinuous network pattern may have advantages, for example strength, over an un-patterned area.

The network pattern area of FIG. 11 includes a ribbed pattern 150 combined with a separate network pattern 151. Such a multi-layered bag 100*c* can be formed using the process 200*b* of FIG. 10. For example, the TD intermeshing rollers 242*a*, 243*a*, 242*b*, 243*b* can form a ribbed pattern 150 in the area 198 of each film 180, 182. Next during the lamination process 298, SELFing intermeshing rollers, embossing intermeshing rollers, DD intermeshing rollers, MD intermeshing rollers, ultrasonics, or adhesives may form a network pattern 151 in the area 198. Furthermore, the lamination process 198 can form bonds between the films 180, 182 in accordance with the network pattern 151.

The network pattern area 198 can extend a distance 195 from top to bottom and typically extends across the at least a portion of the width of the multi-layered bag 100*c*. The distance 195 can have a first range of 1.0 inches to 22.0 inches, a second range of 12.0 inches to 21.0 inches, a third range of 14.0 inches to 20.0 inches, and a fourth range of 4.0 to 7.0 inches. In one or more implementations, the distance 195 may be about 5.0 inches or about 21.0 inches.

Figure 12:
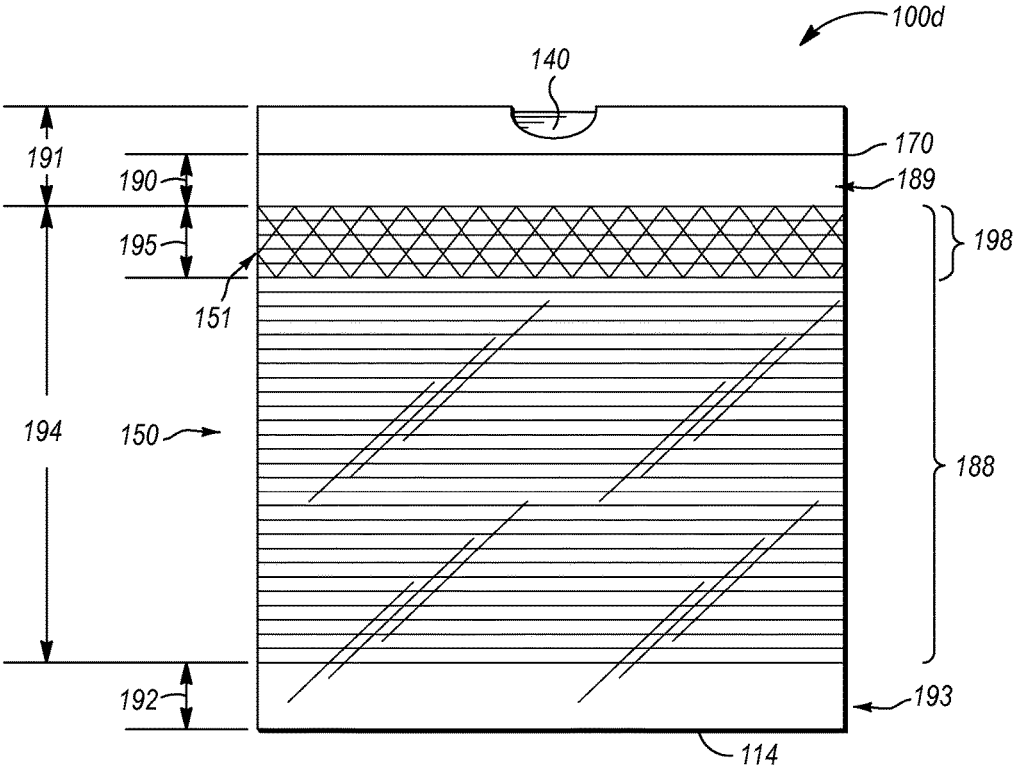
FIG. 12 illustrates a view of a non-continuously laminated multi-layered bag with a separate network and ribbed patterns in accordance with one or more implementations of the present invention.

One will appreciate that the multi-layered bags of the present invention can include ribbed patterned areas separate or combined with network patterns. For example, FIG. 12 illustrates a multi-layered bag 100*d* similar to the multi-layered bag 100*c* of FIG. 11, albeit that the multi-layered bag 100*d* includes a ribbed patterned area 188 separate from the network pattern 198.

Figure 13:
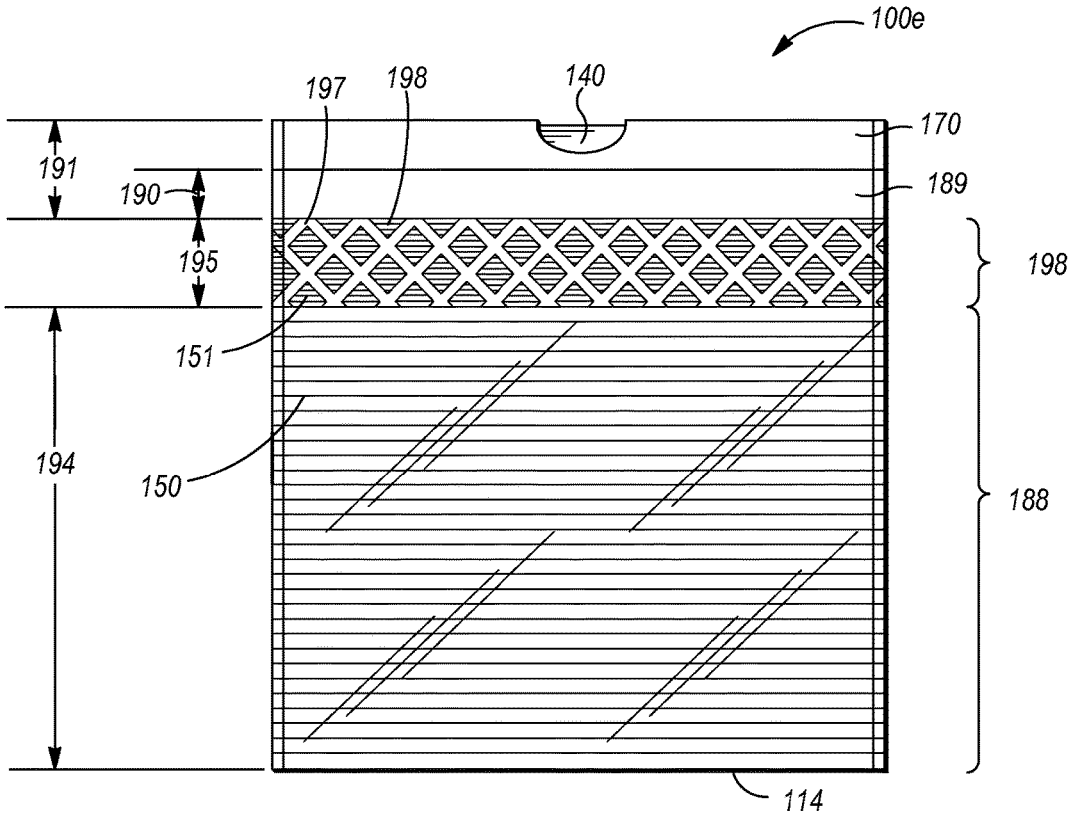
FIG. 13 illustrates a view of another non-continuously laminated multi-layered bag with a separate network and ribbed patterns in accordance with one or more implementations of the present invention.

Furthermore, the network patterns need not be combined with a ribbed pattern. For example, FIG. 13 illustrates yet another multi-layered bag 100*e* with ribbed patterned area 188 and a separate network pattern area 198 devoid of a ribbed pattern 150. In particular, the network pattern area 198 includes a network pattern comprising a structural elastic like film.

For example, the network patterns can be formed using a structural elastic like film (SELF) process, which similarly also results in non-continuous bonding of adjacent layers within a multi-layer film. As explained in greater detail below, the stainable networks can include adjacent bonded and un-bonded regions. U.S. Pat. No. 5,518,801; U.S. Pat. No. 6,139,185; U.S. Pat. No. 6,150,647; U.S. Pat. No. 6,394,651; U.S. Pat. No. 6,394,652; U.S. Pat. No. 6,513,975; U.S. Pat. No. 6,695,476; U.S. Patent Application Publication No. 2004/0134923; and U.S. Patent Application Publication No. 2006/0093766 each disclose processes for forming strainable networks or patterns of strainable networks suitable for use with implementations of the present invention. The contents of each of the aforementioned patents and publications are incorporated in their entirety by reference herein.

For example, the strainable network of the network pattern area 198 can include un-bonded regions 197, bonded regions 198 dispersed about the un-bonded regions 197. The bonded regions 198 can form the raised rib-like elements of the strainable network. The bonded regions 198 can be discontinuous or separated as they extend across the multi-layered bag 100*e* in both transverse and machine directions. This is in contrast to ribs 152 that extend continuously across a film in one of the machine direction.

The rib-like elements 198 can allow the multi-layered bag 100*e* to undergo a substantially "geometric deformation" prior to a "molecular-level deformation" or a "macro-level deformation." As used herein, the term "molecular-level deformation" refers to deformation which occurs on a molecular level and is not discernible to the normal naked eye. That is, even though one may be able to discern the effect of molecular-level deformation, e.g., macro-level deformation of the film, one is not able to discern the deformation which allows or causes it to happen. As used herein, the term "macro-level deformation" refers to the effects of "molecular-level deformation," such as stretching, tearing, puncturing, etc. In contrast, the term "geometric deformation," which refers to deformations of multi-layered bag 100*e* which are generally discernible to the normal naked eye, but do not cause the molecular-level deformation when the multi-layered bag 100*e* is subjected to an applied strain. Types of geometric deformation include, but are not limited to bending, unfolding, and rotating.

Thus, upon application of strain, the rib-like elements 198 can undergo geometric deformation before either the rib-like elements 198 or the flat regions undergo molecular-level deformation. For example, an applied strain can pull the rib-like elements 198 back into plane with the flat regions (i.e., un-bonded regions 197) prior to any molecular-level deformation of the multi-layered bag 100*e*. Geometric deformation can result in significantly less resistive forces to an applied strain than that exhibited by molecular-level deformation.

In addition to improved properties thus provided by the ability to geometrically deform, the SELF'ing process also can discontinuously and lightly laminate adjacent layers of the multi-layered bag 100*e* together, providing the benefits noted above. In particularly, the film layers 180, 182 can be lightly laminated at the bonded regions 198, but un-bonded at regions 197. The strength of the lamination bond is relatively weak, so as to be less than the weakest tear resistance of the individual layers of the multi-layer bag 100*e*. Thus, the lamination bond is broken rather than the individual layer tearing upon application of a force. Typically, tearing in the MD direction requires less applied force than tearing in the TD direction, thus in one embodiment, the lamination bond strength is less than the MD tear resistance of each individual layer of the multi-layer film.

The strainable network pattern may provide improved properties compared to a continuous smooth film. For example, the strainable network pattern may provide improved tear and impact properties. This may especially be true when the strainable network pattern is separated from the hem by a smooth region. Having either a smooth area or a continuous ribbed area below the discontinuous network pattern, may also improve the bag properties.

Additional examples of a network patterned area having lower surface contact would be an embossed network patterned area below the hem. The method of embossing the film of the present invention can involve calendar embossing the film with discrete "icons" to form raised icons extending beyond the plane of the film, each icon having an icon length and separated from adjacent icons by a non-raised portion. By "icon" as used herein is meant a single, discrete, design or shape, such as a heart, square, triangle, diamond, trapezoid, circle, polygon formed essentially as a line drawing.

While certain icons may have portions not describable as a "line" (such as eyes of animals, etc.), the overall design comprises primarily lines in a pattern to make the design or shape. In one example in FIG. 20, the embossed icons are circles. In suitable examples, the raised icon area is larger than the non-raised area around the icons. Where the icons are printed, instead of embossed, the icons are not raised from the plane of the film but are separated from each other by the absence of lines. The icon area can represent greater than 10%, or greater than 50%, or greater than 60%, or greater than 70%, or greater than 80% of the total network patterned area. The film may be embossed with a pattern that provides texture to the film, but with no additional overall stretching. The film may be embossed by feeding between two rolls, one or both of which have an embossing pattern. The rolls may be heated or unheated.

The film may be coated or printed with an ink to form a network pattern. Depending upon the composition, various coating and printing process may be appropriate. For instance, in addition to ink jet printing and other non-impact printers, the composition can be used in screen printing processes, offset lithographic processes, flexographic printing processes, rotogravure printing processes, and the like. In other cases, a coating process may be appropriate. In the gravure coating process, an engraved roller runs in coating bath which fills the engraved recesses in engraved roller with excess additive delivery slurry. The excess slurry on engraved roller is wiped off engraved roller by doctor blade, with engraved roller thereafter depositing additive delivery slurry layer onto substrate film as substrate film passes between engraved roller and pressure roller.

Figure 14:
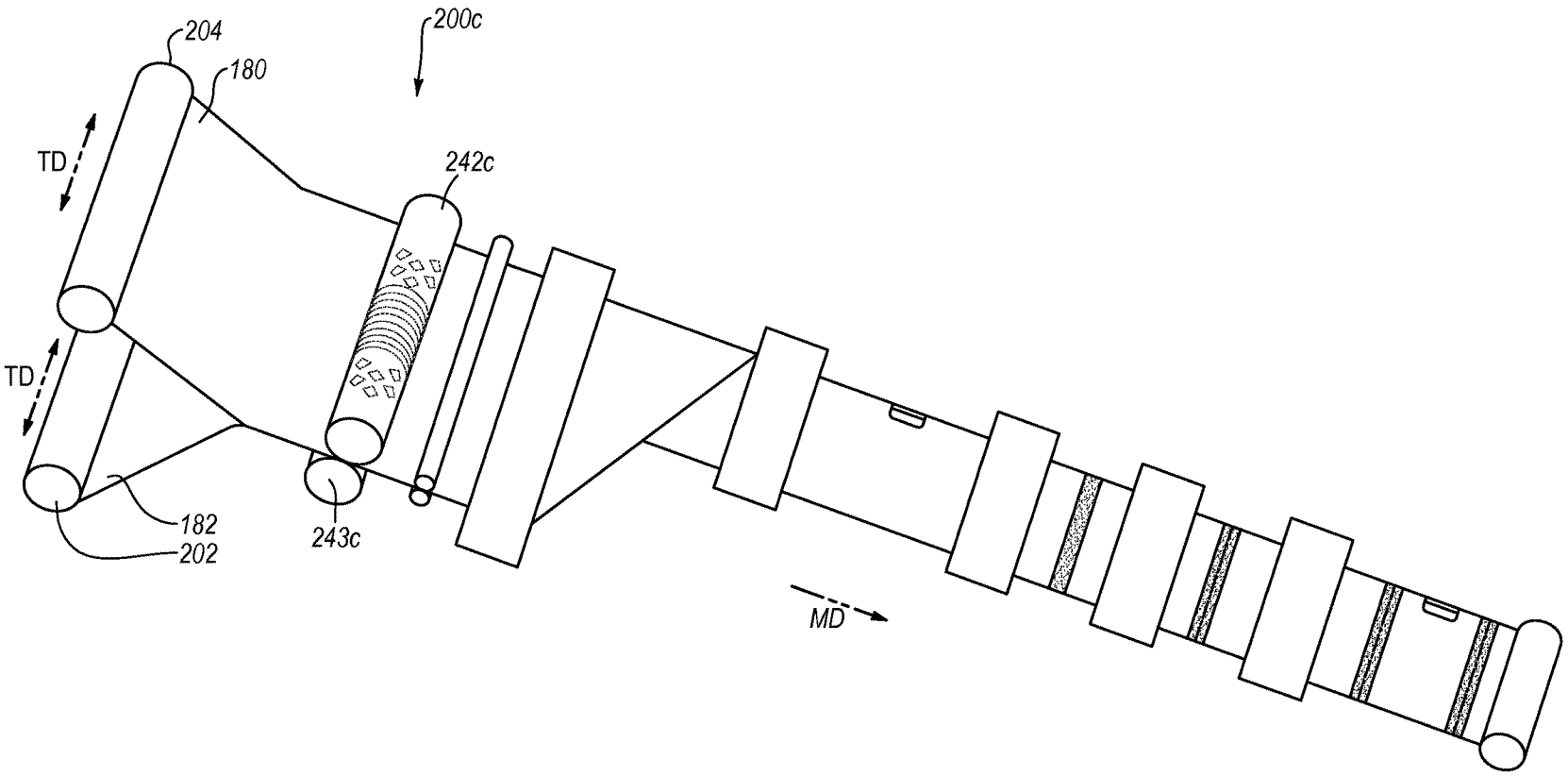
FIG. 14 illustrates a schematic view depicting a high-speed manufacturing process for producing multi-layered thermoplastic bags having ribbed and/or network patterns in accordance with one or more implementations of the present invention.

FIG. 14 illustrates another manufacturing process 200*c* for producing a multi-layered bag with increased strength and/or reduced material. The process 200*c* can be similar to process 200 of FIG. 7, except that both a ribbed pattern and a network pattern are formed in one or more of the film layers 180, 182. For example, the film layers 180, 182 can both pass through a pair of combination intermeshing rollers 242*c*, 243*c*. The combination intermeshing rollers 242*c*, 243*c* can include one or more sections for creating a ribbed pattern (i.e., ridges and grooves extending in the machine direction). The combination intermeshing rollers 242*c*, 243*c* can further include one or more sections for creating a network pattern (such as a SELFing pattern, an embossing pattern, or the other network patterns described herein above).

In alternative implementations, the process 200*c* can include a pair of TD intermeshing rollers which form a ribbed pattern in one or more of the first and second film layers 180, 182. The process 200*c* can then include a second pair of intermeshing rollers, an adhesive applicator, an ultrasonic horn, or other mechanism for creating a network pattern. In any event, the process 200*c* can create a ribbed pattern (which optionally includes bonds) and a network pattern (which optionally includes bonds).

Exemplary implementations are described herein. Variations of those implementations may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A thermoplastic bag having improved strength comprising:

a first sidewall comprising a first layer of a thermoplastic material and an adjacent second layer of thermoplastic material, wherein:

the first layer comprises a first plurality of thicker linear ribs and a first plurality of thinner stretched regions, the thicker linear ribs of the first plurality of thicker linear ribs alternating with the thinner stretched regions of the first plurality of thinner stretched regions; and the second layer comprises a second plurality of thicker linear ribs and a second plurality of thinner stretched regions, the thicker linear ribs of the second plurality of thicker linear ribs alternating with the thinner stretched regions of the second plurality of thinner stretched regions, wherein the second plurality of thicker linear ribs are parallel to the first plurality of thicker linear ribs;

a second sidewall comprising a first layer of a thermoplastic material and an adjacent second layer of thermoplastic material, wherein the second sidewall is joined to the first sidewall along a first side edge, an opposite second side edge, and a closed bottom edge, the first and second sidewalls being un-joined along at least a portion of their respective top edges to define an opening; and a first plurality of partially discontinuous bonded regions securing the first and second layers of the first sidewall together, the first plurality of partially discontinuous bonded regions being aligned with and directly securing every other thicker linear rib of the first plurality of thicker linear ribs of the first layer to a thicker linear rib of the second plurality of thicker linear ribs of the second layer, wherein the thinner stretched regions and thicker linear ribs of the first layer alternating with the every other thicker linear rib of the first layer bonded to thicker linear ribs of the second layer are unbounded to the thicker linear ribs of the second layer.

2. The thermoplastic bag as recited in claim 1, wherein the first plurality of thicker linear ribs, the first plurality of thinner stretched regions, the second plurality of thicker linear ribs, the second plurality of thinner stretched regions, and the first plurality of partially discontinuous bonded regions extend from the first side edge to the second side edge.

3. The thermoplastic bag as recited in claim 1, wherein the first sidewall comprises at least:

a bottom portion proximate the bottom edge;

a top portion proximate the opening; and a middle portion between the bottom portion and the top portion;

wherein the first plurality of partially discontinuous bonded regions are located in the middle portion of the first sidewall and wherein one or more of the top portion or the bottom portion is un-patterned.

4. The thermoplastic bag as recited in claim 1, wherein the thinner stretched regions in the second layer are substantially unbounded to the first layer.

5. The thermoplastic bag as recited in claim 3, wherein:

the middle portion has a first average thickness;

the un-patterned portion has a second average thickness, and the first average thickness is less than the second average thickness.

6. The thermoplastic bag as recited in claim 3, wherein:

the first sidewall further includes an upper-middle portion positioned between the top portion and the middle portion; and the upper-middle portion includes a discontinuous network pattern extending linearly between the first side edge and the second side edge.

7. The thermoplastic bag as recited in claim 6, wherein the discontinuous network pattern comprises a strainable network of ribs that discontinuously bond the first and second layers of the first sidewall together.

8. The thermoplastic bag as recited in claim 1, wherein a bond strength of the non-continuous bonded regions is less than a weakest tear resistance of either of the first and second layers of the first sidewall.

9. The thermoplastic bag as recited in claim 3, wherein the un-patterned portion is un-bonded.

10. The thermoplastic bag as recited in claim 3, wherein the bottom portion is un-bonded.

11. A multi-layered bag, comprising:

a first thermoplastic bag, the first thermoplastic bag comprising first and second opposing sidewalls joined together along a first side edge, an opposite second side edge, and a closed bottom edge, the first and second sidewalls being un-joined along at least a portion of their respective top edges to define an opening, the first thermoplastic bag comprising a bottom portion proximate the bottom edge, a top portion proximate the opening, and a middle portion between the bottom portion and the top portion, wherein the first thermoplastic bag comprises a first plurality of thicker linear ribs and a first plurality of thinner stretched regions, the thicker linear ribs of the first plurality of thicker linear ribs alternating with the thinner stretched regions of the first plurality of thinner stretched regions;

a second thermoplastic bag positioned within the first thermoplastic bag, the second thermoplastic bag comprising third and fourth opposing sidewalls joined together along a first side edge, an opposite second side edge, and a closed bottom edge, the third and fourth sidewalls being un-joined along at least a portion of their respective top edges to define an opening, the second thermoplastic bag comprising a bottom portion proximate the bottom edge, a top portion proximate the opening, and a middle portion between the bottom portion and the top portion, wherein the second thermoplastic bag comprises a second plurality of thicker linear ribs and a second plurality of thinner stretched regions, the thicker linear ribs of the second plurality of thicker linear ribs alternating with the thinner stretched regions of the second plurality of thinner stretched regions;

wherein the first plurality of thicker linear ribs and the second plurality of thicker linear ribs are parallel;

the thicker linear ribs extending between the first side edge and the second side edge; and a plurality of partially discontinuous bonds being aligned with and securing every other thicker linear rib of the first plurality of thicker linear ribs of the first layer directly to a thicker linear rib of the second plurality of thicker linear ribs of the second layer such that each bond extends along and is parallel to both a thicker linear rib of the first plurality of thicker linear ribs and a thicker linear rib of the second plurality of thicker linear ribs that the bond secures together;

wherein the thinner stretched regions and thicker linear ribs of the first layer alternating with the every other thicker linear rib of the first layer bonded to thicker linear ribs of the second layer are unbounded to the thicker linear ribs of the second layer.

12. The multi-layered bag as recited in claim 11, wherein the plurality of partially discontinuous bonds comprise one or more of pressure bonds, ultrasonic bonds, or adhesive bonds.

13. The multi-layered bag as recited in claim 11, wherein the thicker linear ribs are in the middle portions of the first and second thermoplastic bags, the middle portions having a first average thickness, and wherein an un-patterned portion of the multi-layered bag has a second average thickness, and the first average thickness is less than the second average thickness.

14. The multi-layered bag as recited in claim 13, wherein the respective bottom portions of the first thermoplastic bag and the second thermoplastic bag are un-patterned and un-bonded.

15. The multi-layered bag as recited in claim 11, wherein:

each of the first and second thermoplastic bags include a discontinuous strainable network that discontinuously secures the first thermoplastic bag and the second thermoplastic bag together.

16. The multi-layered bag as recited in claim 15, wherein the discontinuous strainable network is positioned in the top portion of the first thermoplastic bag.

17. The multi-layered bag as recited in claim 16, further comprising a draw tape around the openings of the first and second thermoplastic bags.

18. The multi-layered bag as recited in claim 17, further comprising an un-patterned section positioned between the draw tape and the discontinuous strainable network.

19. The multi-layered bag as recited in claim 11, wherein respective top edges of the first and second thermoplastic bags are secured together such that an area between the first and second thermoplastic bags is inaccessible.

20. The thermoplastic bag as recited in claim 1, wherein the respective top edges of the first and second layers are secured together such that an area between the first and second layers is inaccessible.

* * * * *